United States Patent [19]

Naito

[11] Patent Number: 5,064,750

[45] Date of Patent: Nov. 12, 1991

[54] METHOD FOR PROCESSING SILVER HALIDE COLOR PHOTOGRAPHIC MATERIAL

[75] Inventor: Hideki Naito, Kanagawa, Japan

[73] Assignee: Fuji Photo Film Co., Ltd., Kanagawa, Japan

[21] Appl. No.: 673,893

[22] Filed: Aug. 4, 1989

[30] Foreign Application Priority Data

Aug. 5, 1988 [JP] Japan ..... 63-195763

[51] Int. Cl.[5] ..... G03C 7/02; G03C 7/32; G03C 7/34

[52] U.S. Cl. ..... 430/393; 430/430; 430/464; 430/552; 430/553

[58] Field of Search ..... 430/393, 430, 461, 552, 430/553

[56] References Cited

U.S. PATENT DOCUMENTS

| | | | |
|---|---|---|---|
| 4,690,889 | 9/1987 | Saito et al. | 430/552 |
| 4,745,048 | 5/1988 | Kishimoto et al. | 430/393 |
| 4,820,623 | 4/1989 | Koshimiza et al. | 430/376 |
| 4,840,877 | 6/1989 | Abe et al. | 430/350 |
| 4,855,218 | 8/1989 | Fujita et al. | 430/490 |
| 4,857,442 | 8/1989 | Fujita et al. | 430/393 |
| 4,910,125 | 3/1990 | Haruuchi et al. | 430/393 |

FOREIGN PATENT DOCUMENTS

| | | |
|---|---|---|
| 329051 | 8/1989 | European Pat. Off. . |
| 334317 | 9/1989 | European Pat. Off. . |
| 121455 | 6/1987 | Japan . |
| 62-222252 | 9/1987 | Japan . |
| 085630 | 4/1988 | Japan . |
| 313153 | 12/1988 | Japan . |
| 1392163 | 4/1975 | United Kingdom . |

OTHER PUBLICATIONS

Derwent Abstracts J63 231342, "Development of Silver Halide. . . ", 9/27/88, Fuji Photo.

Derwent Abstracts J63 250651, "Treating of Silver Solids. . . ", 10/18/88, Fuji Photo.

Derwent Abstracts J01 062643, "Treating Silver-Halide . . . ", 3/9/89, Fuji Photo.

*Primary Examiner*—Charles L. Bowers, Jr.

*Assistant Examiner*—Patrick Doody

*Attorney, Agent, or Firm*—Sughrue, Mion, Zinn, Macpeak & Seas

[57] ABSTRACT

The invention discloses an improved method for processing a silver halide color photographic material wherein said material is imagewise exposed and then processed. The improvement comprises the use of a particular naphthol amido coupler together with a bleaching bath containing (diaminopropanetetraacetatoiron) (III) complex salt at a particular pH.

13 Claims, No Drawings

METHOD FOR PROCESSING SILVER HALIDE COLOR PHOTOGRAPHIC MATERIAL

FIELD OF THE INVENTION

This invention relates to a processing method for color photosensitive materials, and in particular it relates to a method for the rapid processing of color negative photosensitive materials for photography.

BACKGROUND OF THE INVENTION

It is well known that color images are formed by using exposed silver halides as oxidizing agents and reacting oxidized primary aromatic amine-based color developing agents with couplers to produce indophenol, indoaniline, indamine, azomethine, phenoxazine, phenazine and analogous dyes.

Of these, it has been noted that with phenol-based couplers or naphthol-based couplers, which are known as cyan image forming couplers, there are disadvantages such as a reduction in the heat- or light-fastness of the color image formed by color development, or a reduction in the color density occurring when development processing is effected using a bleaching solution (bleach-fixing solution) which has a weak oxidizing power or an exhausted bleaching solution (bleach-fixing solution). In order to improve upon such disadvantages, phenol-based cyan couplers which have a phenylureido group in the 2-position and a carbonamido group in the 5-position have ,been proposed. These couplers are disclosed, for example, in JP-A-56-65134, JP-A-57-204543, JP-A-57-204544, JP-A-57-204545, JP-A-58-33249 and JP-A-58-33250 (the term "JP-A" as used herein means an "unexamined published Japanese patent application"). These couplers are certainly superior to conventionally known phenol-based cyan couplers and naphthol-based cyan couplers as a result of the abovementioned reasons. But, as noted in JP-A-59-46644, for example, they have disadvantages. For example, the spectral absorption of the colored image varies markedly in accordance with the color density; crystal deposition occurs if sufficiently high-boiling organic solvents are not used on account of their poor solubility; and the color-forming properties are reduced. For these reasons the emulsion film is thick and the sharpness is poor.

On the other hand, naphthol-based cyan couplers having an amido group in the 5-position have been proposed in the laid-open European Patent No. 161626A with a view to reducing the abovementioned reliance of the color density on the spectral absorption of the coupler. As a result of diligent research the present inventors have discovered that the color-forming imperfections and crystal deposition which occur when using, together with small amounts of high-boiling organic solvents, conventional phenol-based cyan couplers having ureido groups in the 2-position which have a high color image fastness and with which there is little color density reduction even with conventional bleaching solutions or bleach-fixing solutions with a weak oxidizing power, do not occur when jointly using these naphthol-based couplers with small amounts of high-boiling organic solvents, and the present inventors have thus made it possible to improve sharpness.

The spread of small-scale retail processing service systems or so-called "mini-labs" in recent years has lead to a strong demand for a reduction in the processing time in order to rapidly meet the customers' processing requirements.

In particular, the strongest demand has been for a reduction in the desilvering stage, which traditionally has occupied the greatest portion of the processing time.

Despite a variety of improvements such as the joint use of bleaching accelerators and the like, there has been a failure to meet this demand because of the basic disadvantage resulting from the weak oxidizing power of ethylenediaminetetraacetic acid iron(III) complex salts which constitute the main bleaching agents used in bleaching solutions and bleach-fixing solutions.

Ferricyanide, dichromates, iron(III) chloride, persulfates, bromates and the like are known as bleaching agents with strong oxidizing potentials. But they have many disadvantages from the point of view of protection of the environment, safety in handling, corrosiveness to metals and the like. As a result, they cannot, presently, be widely used for retail processing or the like.

Given this background, a bleaching solution with a pH of about 6 and containing a (1,3-diaminopropanetetraacetato)iron(III) complex salt as mentioned in JP-A-62-222252 has a greater oxidizing power and is capable of more rapid silver bleaching than bleaching solutions containing ethylenediaminetetraacetic acid iron(III) complex salts. But this bleaching solutions has the disadvantage that color fogging known as "bleached fog" occurs if the bleaching process is carried out directly after color development without the intervention of a bath.

Even disregarding the problem of bleached fog, it has become clear that a new problem, a large increase in staining during the storage of the photosensitive material after processing, will occur if processing is carried out after shortening the bleaching time by using the bleaching solution discussed in the paragraph above.

SUMMARY OF THE INVENTION

A first object of this invention is to provide silver halide color photographic materials for which the cyan color density is not reduced even if processing is carried out using an exhausted bleaching solution.

A second object of the invention is to provide silver halide color photographic materials in which there is little staining after processing.

A third object of the invention is to provide a processing method with which a shortening of processing time is possible.

The objects of this invention are achieved by means of, in a method for processing a silver halide color photographic material comprising a support having provided thereon at least one hydrophilic colloid layer wherein the material is imagewise exposed and then processsed, the improvement comprising:

(a) providing in the at least one hydrophilic colloid layer at least one compound represented by the following general formula (A):

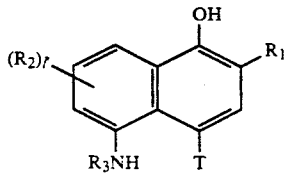

(A)

wherein, $R_1$ represents a halogen atom, an aliphatic group, an aromatic group, a heterocyclic group, an amidino group, a guanidino group or a group represented by $-COR_4$, $-SO_2R_4$, $-SOR_4$, $-NHCOR_4$, $-NHSO_2R_4$, $-NHSOR_4$,

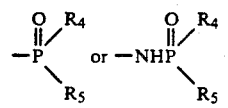

wherein $R_4$ and $R_5$, which may be the same or different, each represents an aliphatic group, an aromatic group, a heterocyclic group, an amino group, an aliphatic oxy group or an aromatic oxy group;

$R_2$ represents a halogen atom, a hydroxyl group, a carboxyl group, a sulfo group, an amino group, a cyano group, a nitro group, an aliphatic group, an aromatic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, an aliphatic sulfinyl group, an aromatic sulfinyl group, an aliphatic oxycarbonyl group, an aromatic oxycarbonyl group, an aliphatic oxycarbonylamino group, an aromatic oxycarbonylamino group, a sulfamoylamino group, a heterocyclic group or an imido group;

l' represents an integer of 0 to 3;

$R_3$ represents a hydrogen atom or $R_6U$ wherein $R_6$ represents a hydrogen atom, an aliphatic group, an aromatic group, a heterocyclic group, $-OR_7$, $-SR_7$, $-COR_8$, $-PO(R_7)_2$, $-PO(-OR_7)_2$, $-SO_2R_7$, $-SO_2OR_7$, $-CO_2R_7$,

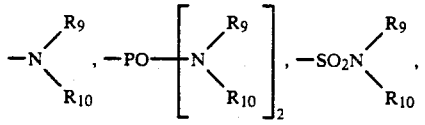

or an imido group, and U represents $>N-R_9$, $-CO-$, $-SO_2-$, $-SO-$ or a single bond wherein $R_7$ represents an aliphatic group, an aromatic group or a heterocyclic group, $R_8$ represents a hydrogen atom, an aliphatic group, an aromatic group or a heterocyclic group, and $R_9$ and $R_{10}$, which may be the same or different, each represents a hydrogen atom, an aliphatic group, an aromatic group, a heterocyclic group, an acyl group, an aliphatic sulfonyl group or an aromatic sulfonyl group; and T represents a hydrogen atom or a group which is capable of elimination by means of a coupling reaction with the oxidized form of a primary aromatic amine developing agent, and when l' is 2 or 3, the $R_2$ groups may be the same or different and may bond together to form a ring, $R_2$ and $R_3$ or $R_3$ and T may respectively bond together to form rings, and in any of $R_1$, $R_2$, $R_3$ or T, mutually bonded dimers or polymers may be formed via divalent or higher than divalent groups; and (b) processing the imagewise exposed photographic material with a bleaching bath containing at least 0.2 mol/liter of a (1,3-diaminopropanetetraacetato)iron(III) complex salt within the range of pH 2.5 to 5.5.

More rapid desilvering is possible with bleaching solutions and bleach-fixing solutions which use (1,3-diaminopropanetetraacetato)iron(III) complex salts since they have a higher bleaching power than the ethylenediaminetetraacetic acid iron(III) complex salts which are most widely used in photographic processing laboratories at present. But they have the disadvantage that bleached fog is liable to occur. The extent of this bleached fog varies with the type of coupler in the photosensitive material, and the present inventors have discovered that by using a coupler of this invention it is specifically possible to inhibit the cyan bleached fog which occurs in bleaching solutions containing (1,3-diaminopropanetetraacetato)iron(III) complex salts when the bleaching power is increased. (For example, when the concentration of the (1,3-diaminopropanetetraacetato)iron(III) complex salt is raised).

The compounds shown in general formula (A) used in this invention are explained below.

Here, aliphatic group denotes a straight-chained, branched or cyclic alkyl group, alkenyl group, or alkynyl group and these may be substituted or unsubstituted. Aromatic group denotes a substituted or unsubstituted aryl group and this may be a condensed ring. Heterocyclic group denotes a substituted or unsubstituted monocyclic or condensed ring heterocyclic group.

Specific examples of the aliphatic groups include a methyl group, an ethyl group, an n-propyl group, an i-propyl group, an n-butyl group, an i-butyl group, a t-butyl group, a cyclopentyl group, a t-pentyl group, a cyclohexyl group, an n-octyl group, a 2-ethylhexyl group, an n-decyl group, an n-dodecyl group, an n-tetradecyl group, an n-hexadecyl group, an n-octadecyl group, a 2-hexyldecyl group, an admantyl group, a trifluoromethyl group, a carboxymethyl group, a methoxyethyl group, a vinyl group, an allyl group, a hydroxyethyl group, a heptafluoropropyl group, a benzyl group, a phenethyl group, a phenoxyethyl group, a methylsulfonylethyl group, a methylsulfonamidoethyl group, a 3-(2-ethylhexyloxy)propyl group, a 3-n-decyloxypropyl group, a 3-n-dodecyloxypropyl group, a 3-n-tetradecyloxypropyl group, an oleyl group, a propargyl group, an ethynyl group, a 3-(2,4-di-t-pentylphenoxy)propyl group, a 4-(2,4-di-t-pentylphenoxy)butyl group, a 1-(2,4-di-t-pentylphenoxy)propyl group, a 1-(2,4-di-t-pentylphenoxy)pentyl group, a 1-(3-tetradecylphenoxy)propyl group and a 2-n-dodecylthioethyl group.

Specific examples of the aromatic groups include a phenyl group, a p-tolyl group, a m-tolyl group, an o-tolyl group, a 4-chlorophenyl group, a 4-nitrophenyl group, a 4-cyanophenyl group, a 4-hydroxyphenyl group, a 3-hydroxyphenyl group, a 1-naphthyl group, a 2-naphthyl group, an o-biphenylyl group, a p-biphenylyl group, a pentafluorophenyl group, a 2-methoxyphenyl group, a 2-ethoxyphenyl group, a 4-methoxyphenyl group, a 4-t-butylphenyl group, a 4-t-octylphenyl group, a 4-carboxyphenyl group, a 4-methylsulfonamidophenyl group, a 4-(4-hydroxyphenylsulfonyl)phenyl group, a 2-n-tetradecyloxyphenyl group, a 4-n-tetradecyloxyphenyl group, a 2-chloro-5-n-dodecyloxyphenyl group, a 3-n-pentadecylphenyl group, a 2-chlorophenyl group, a 4-methoxycarbonylphenyl group, a 4-methylsulfonylphenyl group, and a 2,4-di-t-pentylphenyl group.

Specific examples of the heterocyclic groups include a 2-pyridyl group, a 3-pyridyl group, a 4-pyridyl group, a 2-furyl group, a 2-thienyl group, a 3-thienyl group, a 4-quinolyl group, a 2-imidazolyl group, a 2-benzimidazolyl group, a 4-pyrazolyl group, a 2-benzoxazolyl group, a 2-benzothiazolyl group, a 1-imidazolyl group, a 1-pyrazolyl group, a 5-tetrazolyl group, a 1,3,4-thiadiazol-2-yl group, a 2-prolyl group, a 3-triazolyl group, a 4-oxazolyl group, a 4-thiazolyl group, a 2-pyrimidyl group, a 1,3,5-triazin-2-yl group, a 1,3,4-oxadiazol-2-yl group, a 5-pyrazolyl group, a 4-pyrimidyl group, a 2-pyrazyl group, a succinimido group, a phthalimido group, a morpholino group, a pyrrolidino group, a piperidino group, an imidazolidine-2,4-dion-3-yl group, an imidazolidine-2,4-dion-1-yl group and an oxazolidine-2,4-dion-3-yl group.

The individual substituent groups in general formula (A) are now described in detail.

In general formula (A), $R_1$ represents a halogen atom, an aliphatic group, an aromatic group, a heterocyclic group, an amidino group, a guanidino group or a group represented by $-COR_4$, $-SO_2R_4$, $-SOR_4$,

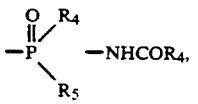

$-NHSO_2R_4$, $-NHSOR_4$ or

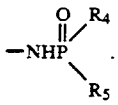

Here, $R_4$ and $R_5$ respectively and independently represent aliphatic groups with 1 to 30 carbon atoms, aromatic groups with 6 to 30 carbon atoms, heterocyclic groups with 1 to 30 carbon atoms, amino groups with 0 to 30 carbon atoms (for example, amino, methylamino, dimethylamino, n-butylamino, anilino, N-(2-n-tetradecyloxyphenyl)amino, pyrrolidino, morpholino, piperidino, 2-ethylhexylamino, n-dodecylamino, N-methyl-N-dodecylamino, 3-dodecyloxypropylamino, 3-(2,4-di-t-pentylphenoxy)propylamino, 4-(2,4-di-t-pentylphenoxy)butylamino), aliphatic oxy groups with 1 to 30 carbon atoms (for example, methoxy, ethoxy, butoxy, methoxyethoxy, n-dodecyloxy, 3-(2,4-di-t-pentylphenoxy)propoxy) or aromatic oxy groups with 6 to 30 carbon atoms (for example, phenoxy, 4-n-dodecyloxyphenoxy, 4-methoxycarbonylphenoxy). $R_4$ and $R_5$ may bond together to form a ring. When $R_1$ is a halogen atom, there are fluorine atoms, chlorine atoms, bromine atoms and iodine atoms for the halogen atom. When $R_1$ is an amidino group or guanidino group, the total number of its carbon atoms is 1 to 30, it may be substituted by aliphatic groups, aromatic groups, hydroxyl groups, aliphatic oxy groups, acyl groups, aliphatic sulfonyl groups, aromatic sulfonyl groups, acyloxy groups, aliphatic sulfonyloxy groups or aromatic sulfonyloxy groups and two nitrogen atoms may bond together to form an imidazole, benzimidazole or other such heterocyclic ring.

In general formula (A), $R_2$ represents a halogen atom (fluorine atom, chlorine atom, bromine atom or iodine atom), a hydroxyl group, a carboxyl group, a sulfo group, a cyano group, a nitro group, an amino group with 0 to 30 carbon atoms (for example, amino, methylamino, dimethyl amino, pyrrolidino, anilino), an aliphatic group with 1 to 30 carbon atoms, an aromatic group with 6 to 30 carbon atoms, a carbonamido group with 1 to 30 carbon atoms (for example, formamido, acetamido, trifluoroacetamido, benzamido), a sulfonamido group with 1 to 30 carbon atoms (for example, methylsulfonamido, trifluoromethylsulfonamido, n-butylsulfonamido, p-tolylsulfonamido), a carbamoyl group with 1 to 30 carbon atoms (for example, carbamoyl N,N-dimethylcarbamoyl, N-methylcarbamoyl, pyrrolidinocarbonyl, N-n-hexadecylcarbamoyl), a sulfamoyl group with 0 to 30 carbon atoms (for example, sulfamoyl, N-methylsulfamoyl, N,N-dimethylsulfamoyl, morpholinosulfonyl, N-n-dodecylsulfamoyl), a ureido group with 1 to 30 carbon atoms (for example, ureido, 3-methylureido, 3-phenylureido, 3,3-dimethylureido), an acyl group with 1 to 30 carbon atoms (for example, acetyl, pivaloyl, benzoyl, dodecanoyl), an acyloxy group with 1 to 30 carbon atoms (for example, acetoxy, benzoyloxy), an aliphatic oxy group with 1 to 30 carbon atoms, an aromatic oxy group with 6 to 30 carbon atoms, an aliphatic thio group with 1 to 30 carbon atoms, an aromatic thio group with 6 to 30 carbon atoms, an aliphatic sulfonyl group with 1 to 30 carbon atoms, an aromatic sulfonyl group with 6 to 30 carbon atoms, an aliphatic sulfinyl group with 1 to 30 carbon atoms, an aromatic sulfinyl group with 6 to 30 carbon atoms, an aliphatic oxycarbonyl group with 2 to 30 carbon atoms, an aromatic oxycarbonyl group with 7 to 30 carbon atoms, an aliphatic oxycarbonylamino group with 2 to 30 carbon atoms, an aromatic oxycarbonylamino group with 7 to 30 carbon atoms, a sulfamoylamino group with 0 to 30 carbon atoms (for example, sulfamoylamino, 3,3-dimethylsulfamoylamino, piperidinosulfonylamino), a heterocyclic group with 1 to 30 carbon atoms or an imido group with 4 to 30 carbon atoms (for example, succinimido, maleinimido, phthalimido, diglycolimido, 4-nitrophthalimido).

In general formula (A), $R_3$ represents a hydrogen atom of $R_6U$. Here, $R_6$ represents a hydrogen atom, an aliphatic group with 1 to 30 carbon atoms, an aromatic group with 6 to 30 carbon atoms, a heterocyclic group with 1 to 30 carbon atoms, $-OR_7$, $-SR_7$ $-COR_8$,

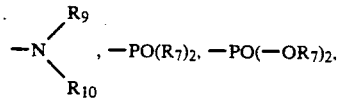

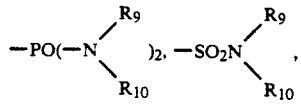

$-CO_2R_7$, $-SO_2R_7$, $-SO_2OR_7$ or an imido group with 4 to 30 carbon atoms (for example, succinimido, maleinimido, phthalimido, diacetylamino), and U represents $>N-R_9$, $-CO-$, $-SO_2$, $-SO-$ or a single bond, $R_7$ represents an aliphatic group with 1 to 30 carbon atoms, an aromatic group with 6 to 30 carbon atoms or a heterocyclic group with 1 to 30 carbon atoms, $R_8$ represents a hydrogen atom, an aliphatic group with 1 to 30 carbon atoms, an aromatic group with 6 to 30 carbon atoms or a heterocyclic group with 1 to 30 carbon atoms, $R_9$ and $R_{10}$ respectively and independently represent hydrogen atoms, aliphatic groups with 1 to 30 carbon atoms, aromatic groups with 6 to 30 carbon atoms, heterocyclic groups with 1 to 30 carbon atoms, acyl groups with 1 to 30 carbon atoms (for example, acetyl, trifluoroacetyl, benzoyl, p-chlorobenzoyl) or sulfonyl group with 1 to 30 carbon atoms (for example, methylsulfonyl, n-butylsulfonyl, phenylsulfonyl, p-nitrophenylsulfonyl). $R_9$ and $R_{10}$ may bond together to form a ring.

In general formula (A), T represents a hydrogen atom or a group which is capable of elimination by means of a coupling reaction with the oxidized form of a primary aromatic amine developing agent. Here, as examples of the latter, there are halogen atoms (fluorine atoms, chlorine atoms, bromine atoms, and iodine atoms), sulfo groups, thiocyanate groups, isothiocyanate groups, selenocyanate groups, aliphatic oxy groups with 1 to 30 carbon atoms, aromatic oxy groups with 6 to 30 carbon atoms, aliphatic thio groups with 1 to 30 carbon atoms, aromatic thio groups with 6 to 30 carbon atoms, heterocyclic thio groups with 1 to 30 carbon atoms, heterocyclic oxy groups with 1 to 30 carbon atoms, aromatic azo groups with 6 to 30 carbon atoms, heterocyclic groups with 1 to 30 carbon atoms, acyloxy groups with 1 to 30 carbon atoms (for example, acetoxy, benzoyloxy), sulfonyloxy groups with 1 to 30 carbon atoms (for example, methylsulfonyloxy, p-tolylsulfonyloxy), carbamoyloxy groups with 1 to 30 carbon atoms (for example, N,N-dimethylcarbamoyloxy, pyrrolidinocarbonyloxy, N-ethylcarbamoyloxy), thiocarbonyloxy groups with 2 to 30 carbon atoms (for example, methylthiocarbonyloxy, phenylthiocarbonyloxy) and carbonyldioxy groups with 2 to 30 carbon atoms (for example, methoxycarbonyloxy, phenoxycarbonyloxy).

In general formula (A), $R_2$ and $R_3$ or $R_3$ and T or a plurality of $R_2$ may respectively bond together to form rings. As examples of the bonding of $R_2$ and $R_3$, there are —$CH_2CO$—, —OCO—, —NHCO—, —$C(CH_3)_2CO$—, —CH=CHCO— and the like. As examples of the bonding of $R_3$ and T, there are —$CH_2C$—, —COO— and the like. As examples of the bonding of a plurality of $R_2$, there are —$(CH_2)_3$—, —$(CH_2)_4$—, —OCO—, —OCONH—, —NHCONH—, —$(CH=CH)_2$—, —$OCH_2O$—, —$OCH_2CH_2O$—, —$OC(CH_3)_2O$— and the like.

Examples of the preferred substituent groups for the compounds represented by general formula (A) are now described below.

In general formula (A), it is preferable that $R_1$ is a halogen atom —$COR_4$ or —$SO_2R_4$ and it is further preferable that $R_4$ is an amino group. As examples of —$COR_4$, there are a carbamoyl group, an N-ethylcarbamoyl group, an N-n-butylcarbamoyl group, an N-cyclohexylcarbamoyl group, an N-(2-ethylhexyl)carbamoyl group, an N-dodecylcarbamoyl group, an N-hexadecylcarbamoyl group, an N-(3-decyloxypropyl)carbamoyl group, an N-(3-dodecyloxypropyl)carbamoyl group, an N-[3-(2,4-di-t-pentylphenoxy)propyl]carbamoyl group, an N-[4-(2,4-di-t-pentylphenoxy)butyl]carbamoyl group, an N,N-dimethylcarbamoyl group, an N,N-dibutylcarbamoyl group, an N-methyl-N-dodecylcarbamoyl group, a morpholinocarbamoyl group, an N-methyl-N-phenylcarbamoyl group, an N-(2-tetradecyloxyphenyl)carbamoyl group, an N-phenylcarbamoyl group, an N-(4-tetradecyloxyphenyl)carbamoyl group, an N-(2-propoxyphenyl)carbamoyl group, an N-(2-chloro-5-dodecyloxyphenyl)carbamoyl group, an N-(2-chlorophenyl)carbamoyl group and the like, and as examples of —$SO_2R_4$ there are a sulfamoyl group, an N-methylsulfamoyl group, an N,N-diethylsulfamoyl group, an N,N-diisopropylsulfamoyl group, an N-(3-dodecyloxypropyl)carbamoyl group, an N-[3-(2,4-di-t-pentylphenoxy)propyl]carbamoyl group, an N-[4-(2,4-di-t-pentylphenoxy)butyl]carbamoyl group, a pyrrolidinosulfonyl group, an N-phenylsulfonyl group, an N-(2-butoxyphenyl)carbamoyl group, an N-(2-tetradecyloxyphenyl)carbamoyl group and the like. The group —$COR_4$ (with $R_4$ an amino group) is particularly preferred for $R_1$.

With regard to $(R_2)_{l'}$ in general formula (A), preferably $l'=0$, following which $l'=1$ When $l'=1$, $R_2$ is preferably a halogen atom, an aliphatic group, an aliphatic oxy group, a carbonamido group, a sulfonamido group, a cyano group or the like, and of these it is particularly preferably a fluorine atom, a chlorine atom, a trifluoromethyl group, a methoxy group or a cyano group. The 2-position or 4-position with respect to $R_3NH$— is preferred as the substitution position for $R_2$.

With regard to $R_3$ in general formula (A), $R_6$ is preferably an aliphatic group, an aromatic group, —$OR_7$ or —$SR_7$ and U is preferably —CO— or —$SO_2$—. Examples of the aliphatic groups include a methyl group, a trifluoromethyl group, a trichloromethyl group, an ethyl group, a heptafluoropropyl group, a t-butyl group, a 1-ethylpentyl group, a cyclohexyl group, a benzyl group, a undecyl group, a tridecyl group and a 1-(2,4-di-t-pentylphenoxy]propyl group, examples of the aromatic groups include a phenyl group, a 1-naphthyl group, a 2-naphthyl group, a 2-chlorophenyl group, a 4-methoxyphenyl group, a 4-nitrophenyl group and a pentafluorophenyl group, examples of —$OR_7$ include a methoxy group, an ethoxy group, an isopropoxy group, an n-butoxy group, an isobutoxy group, a t-butoxy group, an n-pentyloxy group, an n-hexyloxy group, an n-octyloxy group, a 2-ethylhexyloxy group, an n-decyloxy group, an n-dodecyloxy group, a 2-methoxyethoxy group, a benzyloxy group, a trichloroethoxy group, a trifluoroethoxy group, a phenoxy group and a p-methylphenoxy group, and examples of —$SR_7$ include a methylthio group, an ethylthio group, an allylthio group, an n-butylthio group, a benzylthio group, an n-dodecylthio group, a phenylthio group, a p-t-octylphenylthio group, a p-dodecylphenylthio group and a p-octyloxyphenylthio group. $R_3$ is more preferably an aliphatic oxycarbonyl group (with $R_6$ as $R_7O$— and U as —CO—) and an aliphatic or aromatic sulfonyl group (with $R_6$ as an aliphatic group or aromatic group and U as —$SO_2O$—), and it is particularly preferably an aliphatic oxycarbonyl group.

In general formula (A), T is preferably a hydrogen atom, a halogen atom, an aliphatic oxy group, an aromatic oxy group, an aliphatic thio group or a heterocyclic thio group. Examples of the aliphatic oxy groups include a methoxy group, an ethoxy group, a 2-hydroxyethoxy group, a 2-chloroethoxy group, a carboxymethoxy group, a 1-carboxyethoxy group, a methoxyethoxy group, a 2-(2-hydroxyethoxy)ethoxy group, a 2-methylsulfonylethoxy group, a 2-methylsulfonyloxyethoxy group, a 2-methylsulfonamidoethyl group, a 2-carboxyethoxy group, a 3-carboxypropoxy group, a 2-(carboxymethylthio)ethoxy group, a 2-(1-carboxytridecylthio)ethoxy group, a 1-carboxytridecyl group, an N-(2-methoxyethyl)carbamoylmethoxy group, a 1-imidazolylmethoxy group and a 5-phenoxycarbonylbenzotriazol-1-ylmethoxy group; examples of the aromatic oxy groups include a 4-nitrophenoxy group, a 4-acetamidophenoxy group, a 2-acetamidophenoxy group, a 4-methylsulfonylphenoxy group and a 4-(3-carboxypropanamido)phenoxy group; examples of the aliphatic thio groups include a methylthio group, a 2-hydroxyethylthio group, a carboxymethylthio group, a 2-carboxyethylthio group, a 1-carboxyethylthio group, a 3-carboxypropylthio group, a 2-dimethylaminoethylthio group, a benzylthio group, an n-dodecylthio group and a 1-carboxytridecylthio group, and examples of the heterocyclic thio groups include a 1-phenyl-1,2,3,4-tetrazol-5-ylthio group, a 1-ethyl-1,2,3,4-tetrazol-5-ylthio group, a 1-(4-hydroxyphenyl)-1,2,3,4-tetrazol-5-ylthio group, a 4-phenyl-1,2,4-triazol-3-ylthio group, a 5-methyl-1,3,4-oxadiazol-2-ylthio group, a 1-(2-carboxyethyl)-1,2,3,4-tetrazol-5-ylthio group, a 5-methylthio-1,3,4-thiadiazol-2-ylthio group, a 5-methyl-1,3,4-thiadiazol-2-ylthio group, a 5-phenyl-1,3,4-oxadiazol-2-ylthio group, a 5-amino-1,3,4-thiadiazol-2-ylthio group, a benzoxazol-2-ylthio group, a 1-methylbenzimidazol-2-ylthio group, a 1-(2-dimethylaminophenyl)-1,2,3,4-tetrazol-5-ylthio group, a benzothiazol-2-ylthio group, a 5-(ethoxycarbonylmethylthio)-1,3,4-thiadiazol-2-ylthio group, a 1,2,4-triazol-3-ylthio group, a 4-pyridylthio group and a 2-pyrimidylthio group. T is more preferably a hydrogen atom, a chlorine atom, an aliphatic oxy group or an aromatic thio group and it is particularly preferably a hydrogen atom or an aliphatic oxy group.

With the couplers represented by general formula (A), there may be formed dimers or higher polymers which bond together via divalent or higher than divalent groups respectively in the substituent groups $R_1$, $R_2$, $R_3$ or T. In such cases, the range for the carbon atoms indicated in the various substituent groups mentioned above may not be kept.

Monomers or copolymers of addition polymerizable unsaturated ethylenic compounds (cyan-color-forming monomers) having cyan dye forming coupler radicals are typical examples of cases in which the coupler represented by general formula (A) forms a polymer. In such cases, the polymer contains a repeating unit of general formula (B) and one or more types of the cyan color-forming repeating units shown in general formula (B) may be included in the polymer, and copolymers which contain one or two or more types of a non-color-forming ethylenic monomer as a copolymer component are also acceptable.

General formula (B)

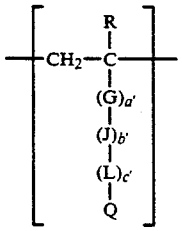

In the formula, R denotes a hydrogen atom, an alkyl group with 1 to 4 carbon atoms or a chlorine atom, G represents —CONH—, —COO— or a substituted or unsubstituted phenylene group, J represents a substituted or unsubstituted alkylene group, phenylene group or aralkylene group, L represents —CONH—, —NHCONH—, —NHCOO—, —NHCO—, —OCONH—, —NH—, —COO—, —OCO—, —CO—, —O—, —$SO_2$—, —$NHSO_2$— or —$SO_2NH$—, a', b' and c' each represents 0 or 1, and Q represents a cyan coupler radical in which a hydrogen atom other than the hydrogen atom in the hydroxyl group in the 1-position has been excluded from a compound represented by general formula (A).

Copolymers of cyan color-forming monomers which provide coupler units of general formula (B) and the following non-color-forming ethylenic monomers are preferred as the polymer.

Non-color-forming ethylenic monomers which do not couple with the oxidation products of primary aromatic amine developing agents include acrylic acid, α-chloroacrylic acid, a-alkylacrylic acids (for example, methacrylic acid), esters or amides derived from these acrylic acids (for example, acrylamide, methacrylamide, n-butyl acrylamide, t-butyl acrylamide, diacetone acrylamide, N-methylol acrylamide, N-(1,1-dimethyl-2-sulfonatoethyl)acrylamide, N-(3-sulfonatopropyl)acrylamide, methyl acrylate, ethyl acrylate, n-propyl acrylate, n-butyl acrylate, t-butyl acrylate, isobutyl acrylate, acetoacetoxyethyl acrylate, n-hexyl acrylate, 2-ethylhexyl acrylate, n-octyl acrylate, lauryl acrylate, methyl methacrylate, ethyl methacrylate, n-butyl methacrylate and β-hydroxy methacrylate), vinyl esters (for example, vinyl acetate, vinyl propionate and vinyl laurate), acrylonitrile, methacrylonitrile, aromatic vinyl compounds (for example, styrene and derivatives thereof such as vinyl toluene, divinyl benzene, potassium styrenesulfinate, vinylacetophenone and sulfostyrene), itaconic acid, citraconic acid, crotonic acid, vinylidene chloride, vinyl alkyl ethers (for example, vinyl ethyl ether), maleic acid esters, N-vinyl-2-pyrrolidone, N-vinylpyridine and 2- and 4-vinylpyridine.

In particular, acrylic acid esters, methacrylic acid esters and maleic acid esters are preferred. Two or more types of the non-color-forming ethylenic monomers used here can be used together. For example, it is possible to use methyl acrylate and butyl acrylate, butyl acrylate and styrene, butyl methacrylate and methacrylic acid, methyl acrylate and diacetone acrylamide, N-(1,1-dimethyl-2-sulfonatoethyl)acrylamide and acrylic acid, potassium styrenesulfinate and N-butylpyrrolidone and the like.

As is well known in the field of polymer couplers, it is possible to select the unsaturated ethylenic monomer for copolymerization with the vinyl-based monomer corresponding to the abovementioned general formula (B) in such a way that the physical characteristics and/or the chemical characteristics of the copolymer which is formed (for example, solubility, compatibility with photographic colloid component binders such as gelatin, plasticity, heat stability and the like) are beneficially influenced.

In order to obtain lipophilic polymer couplers which are soluble in organic solvents, it is preferable to select mainly lipophilic non-color-forming ethylenic monomers (for example, acrylic acid esters, methacrylic acid esters, maleic acid esters and vinyl benzenes) as copolymer components.

A preparation in which the lipophilic polymer coupler obtained by polymerization of the vinyl-based monomer giving a coupler unit represented by the abovementioned general formula (B) can be produced by emulsification and dispersion in the form of a latex in an aqueous gelatin solution or by a direct emulsification polymerization method.

It is possible to use the method mentioned in U.S. Pat. No. 3,451,820 as the method for emulsifying and dispersing the lipophilic polymer coupler in the form of a latex in an aqueous gelatin solution or the method mentioned in U.S. Pat. Nos. 4,080,211 and 3,370,952 for the emulsion polymerization.

Furthermore, in order to obtain hydrophilic polymer couplers which are soluble in neutral or alkaline water, it is preferable to use, as copolymer components, hydrophilic non-color-forming ethylenic monomers such as N-(1,1-dimethyl-2-sulfonatoethyl)acrylamide, 3-sulfonatopropyl acrylate, sodium styrenesulfonate, potassium 2-styrenesulfinate, acrylamide, methacrylamide, acrylic acid, methacrylic acid, N-vinylpyrrolidone and N-vinylpyridine.

It is possible to add the hydrophilic polymer couplers to coating solutions as aqueous solutions, or to add them by dissolving in a mixed solvent of water and an organic solvent which is miscible with water such as a lower alcohol, tetrahydrofuran, acetone, ethyl acetate, cyclohexane, ethyl lactate, dimethylformamide and dimethylacetamide. Furthermore, they may also be added by dissolving in aqueous alkali solutions or alkali-containing organic solvents. Again, small amounts of surfactants may also be added.

Specific examples of couplers represented by general formula (A) and used in this invention are given below, but the invention is not limited to these.

(A-1)

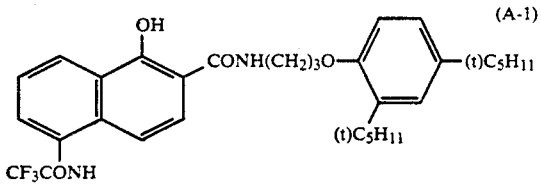

(A-2)

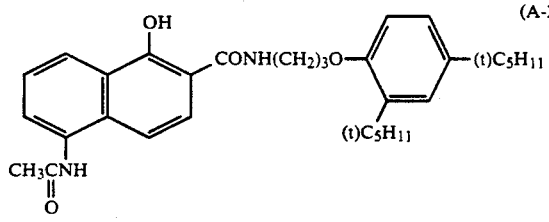

(A-3)

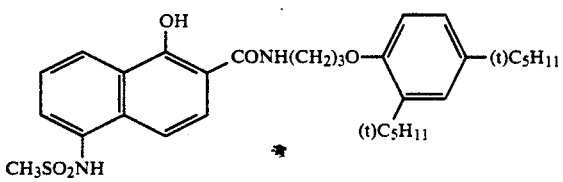

(A-4)

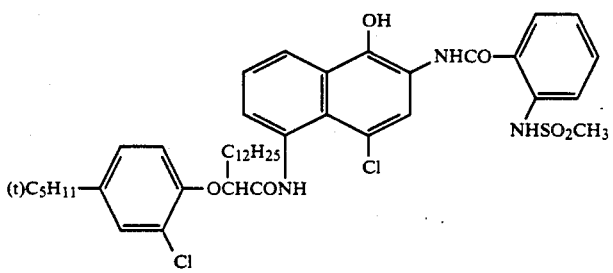

(A-5)

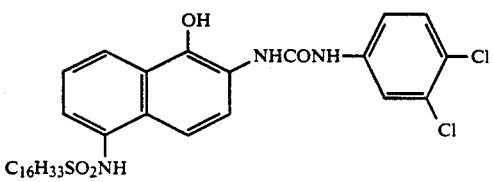

(A-6)

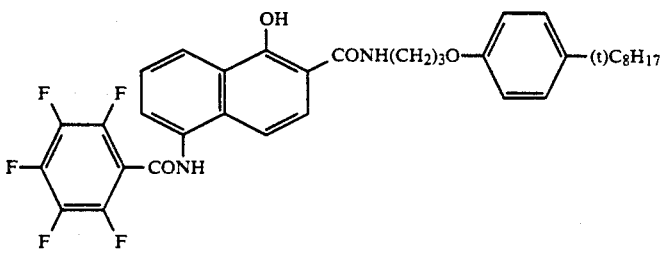

-continued
(A-7)
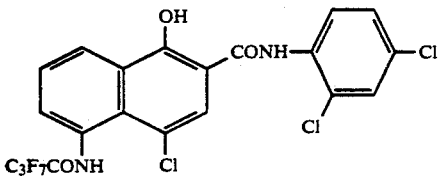
(A-8)
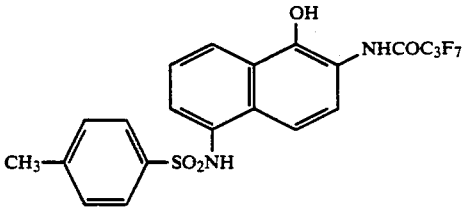
(A-9)
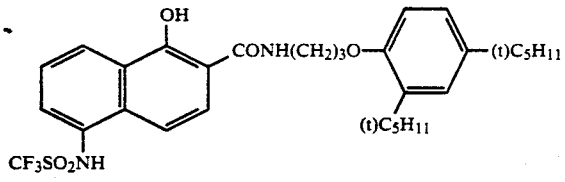
(A-10)
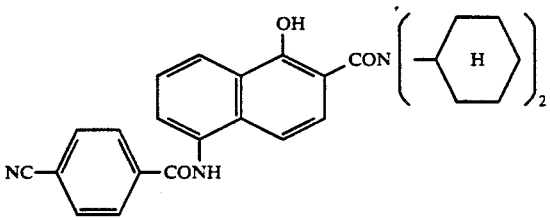
(A-11)
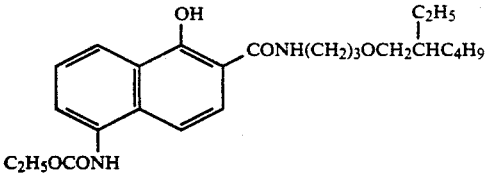
(A-12)
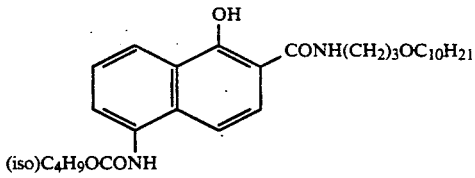
(A-13)
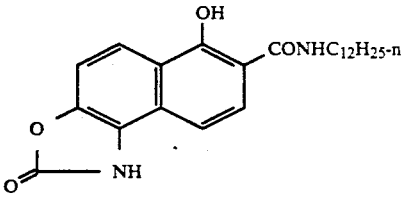
(A-14)
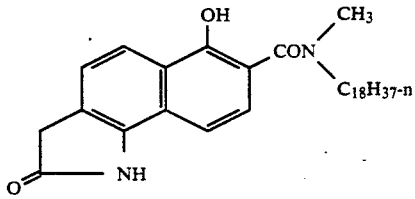
(A-15)
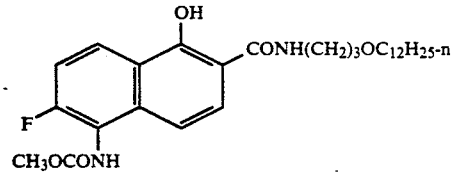
(A-16)
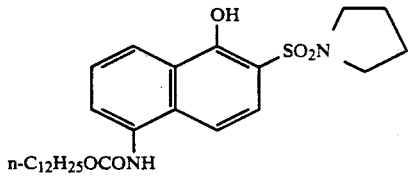
(A-17)
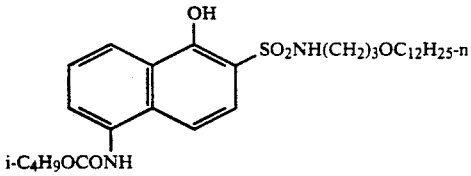
(A-18)
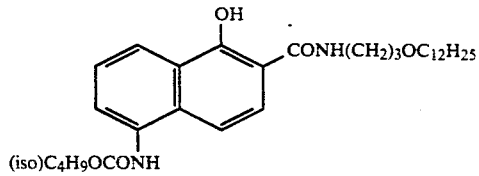
(A-19)
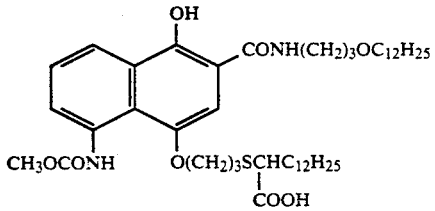
(A-20)
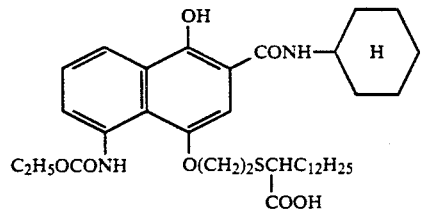

-continued
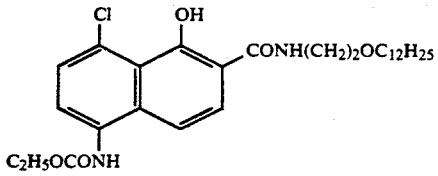
(A-21)
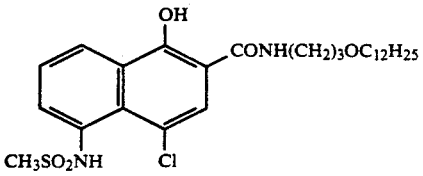
(A-22)
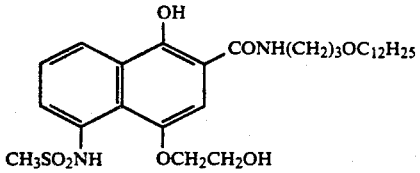
(A-23)
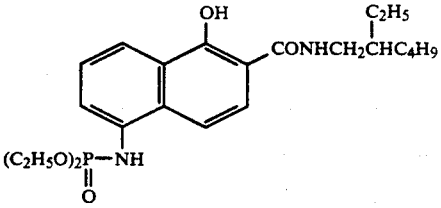
(A-24)
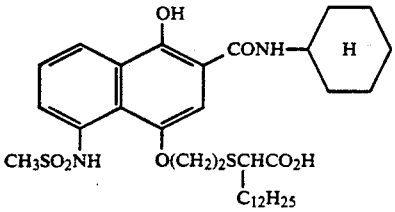
(A-25)
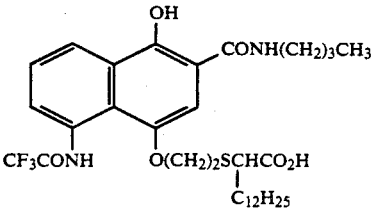
(A-26)
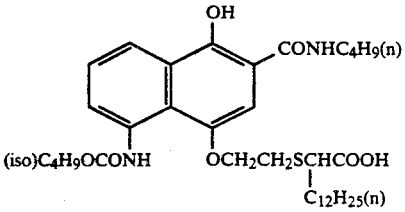
(A-27)
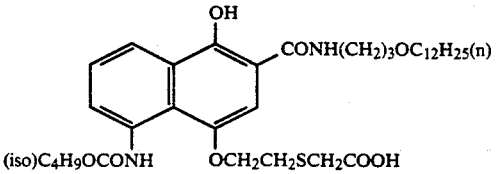
(A-28)
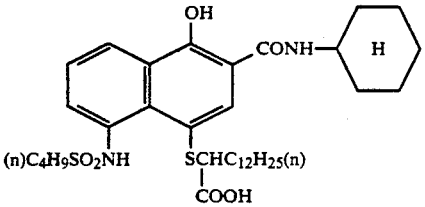
(A-29)
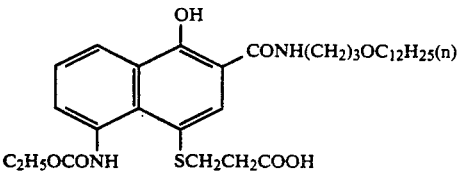
(A-30)
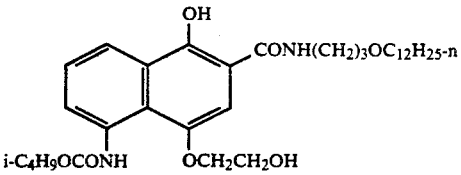
(A-31)
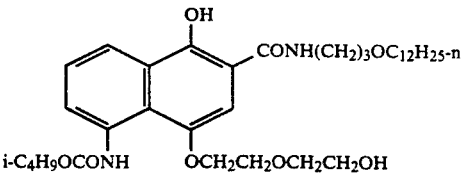
(A-32)
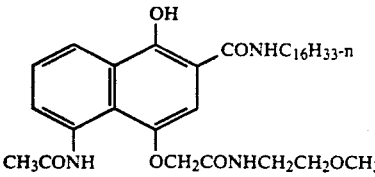
(A-33)
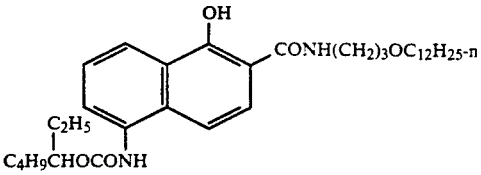
(A-34)

-continued
(A-35)
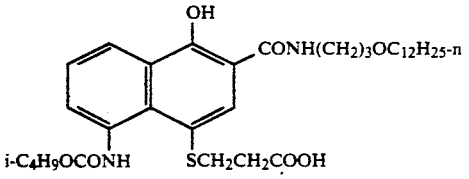
(A-36)
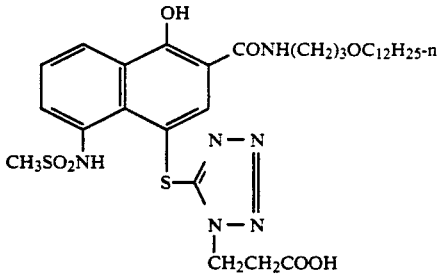
(A-37)
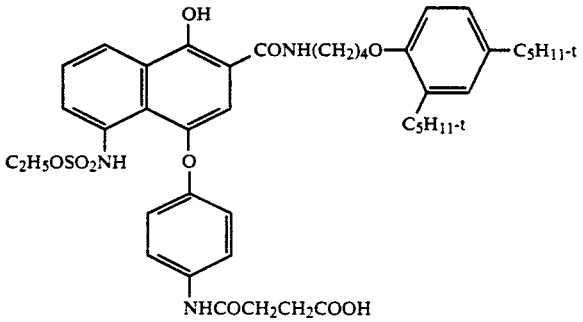
(A-38)
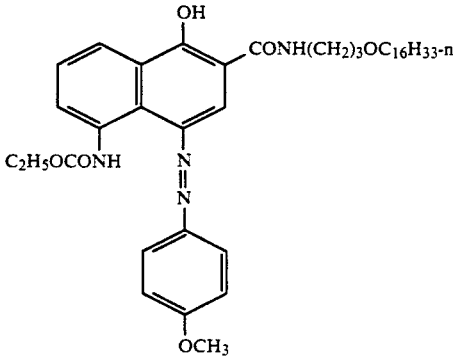
(A-39)
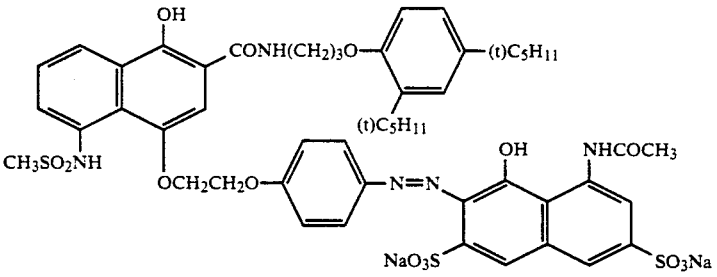
(A-40)
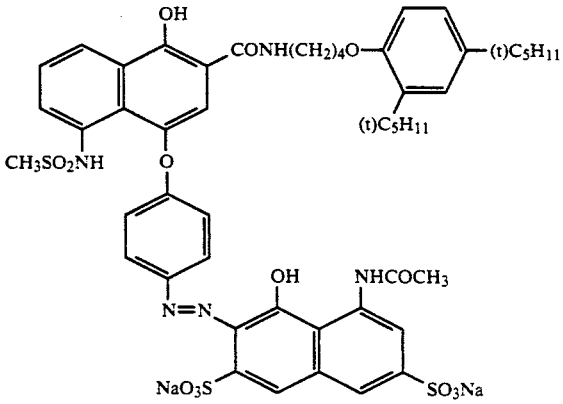

-continued
(A-41)
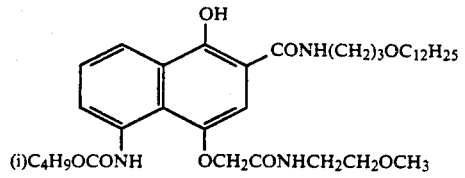
(A-42)
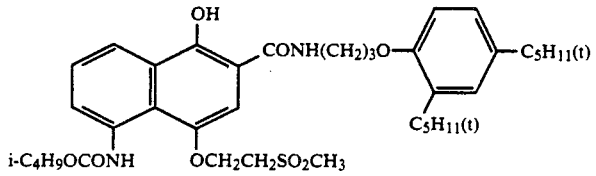
(A-43)
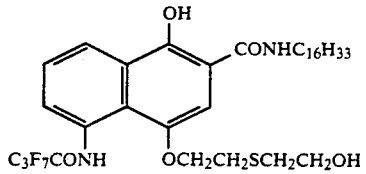
(A-44)
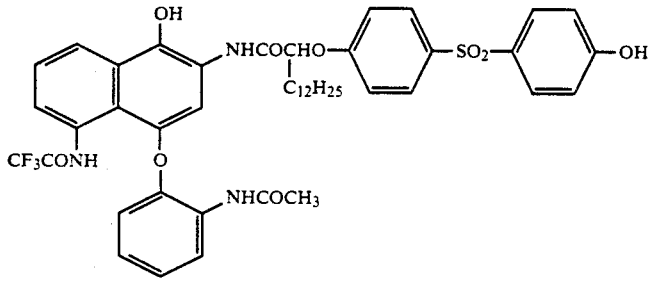
(A-45)
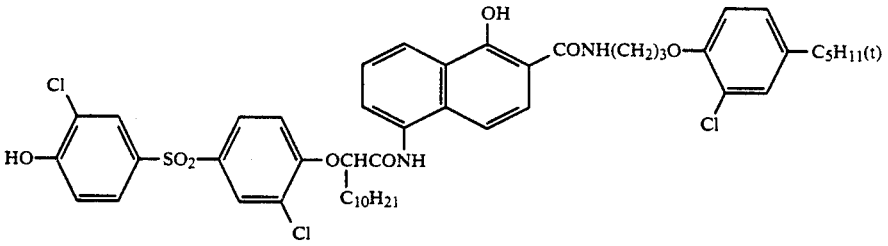
(A-46)
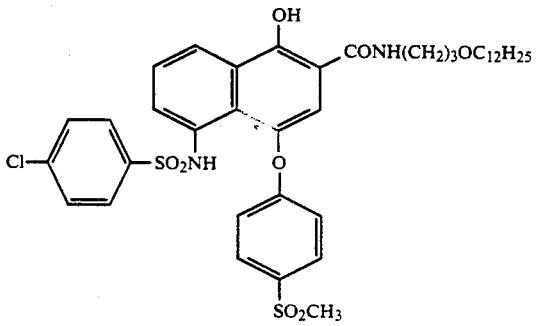

-continued
(A-47)
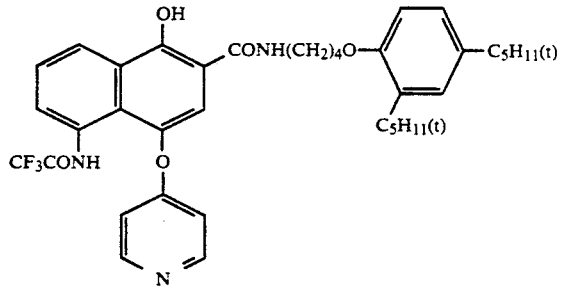
(A-48)
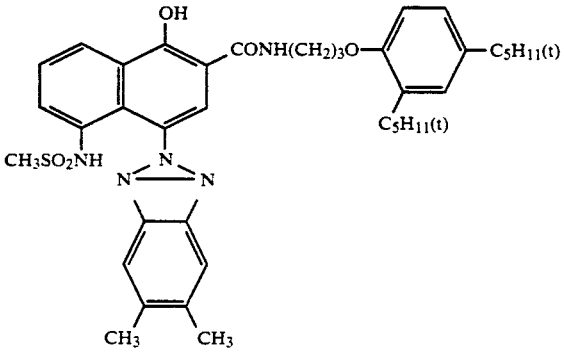
(A-49)
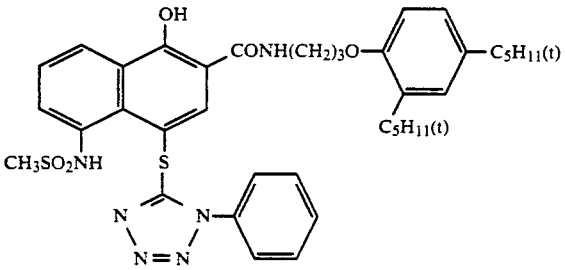
(A-50)
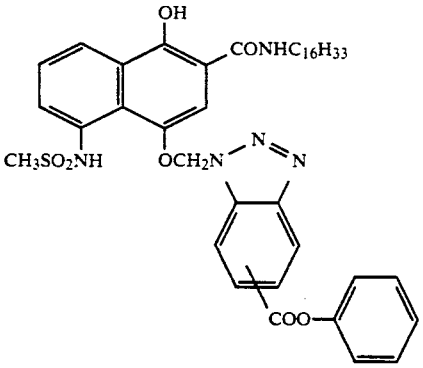
(A-51)
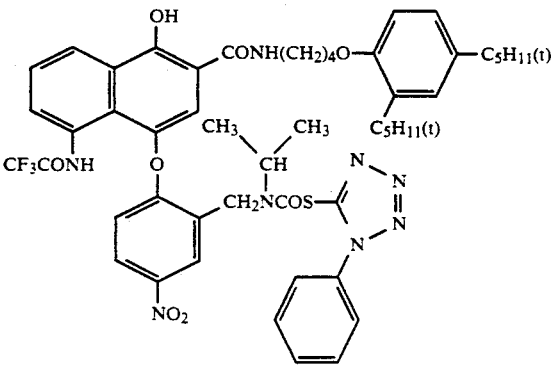

-continued
(A-52)
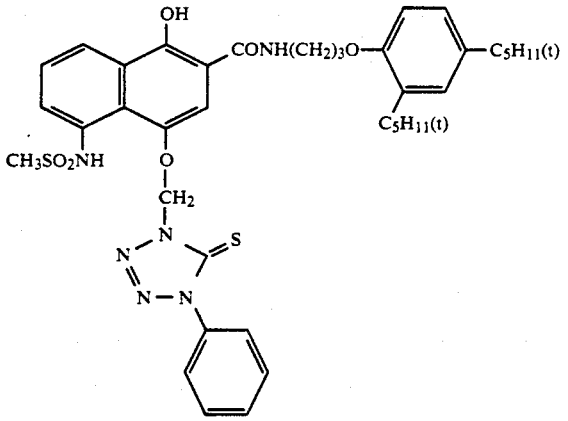
(A-53)
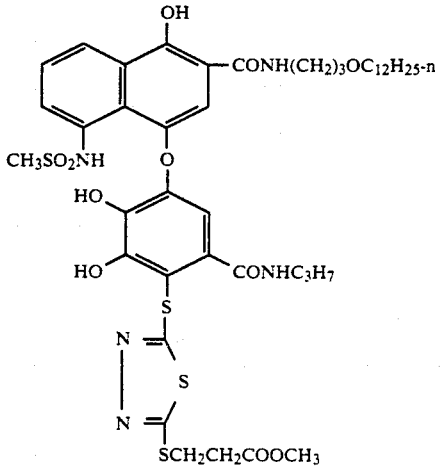
(A-54)
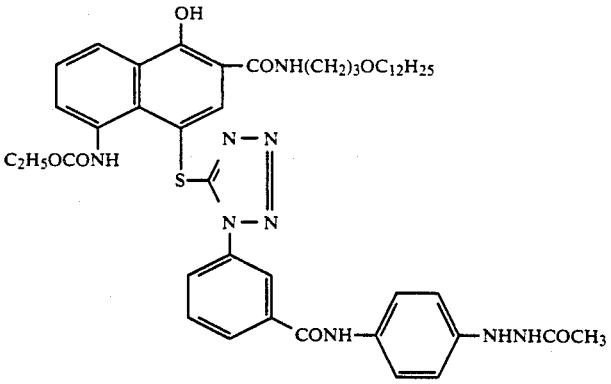
(A-55)
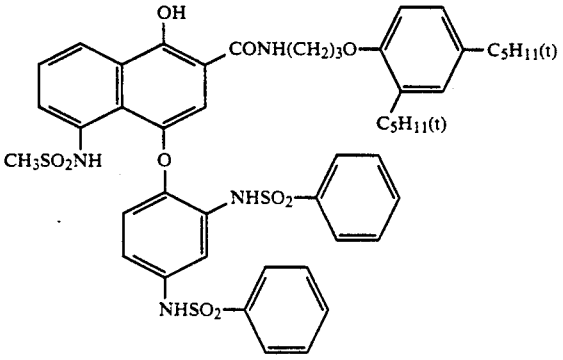

-continued
(A-56)
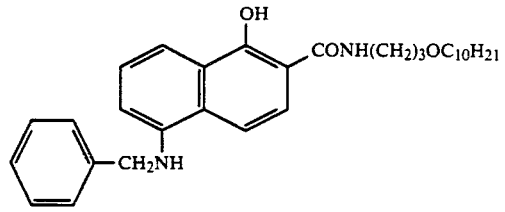
(A-57)
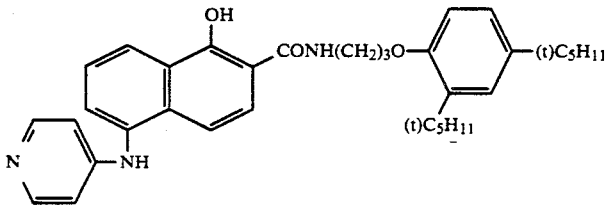
(A-58)
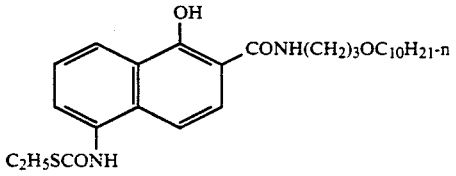
(A-59)
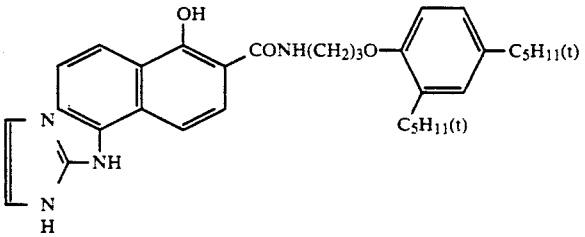
(A-60)
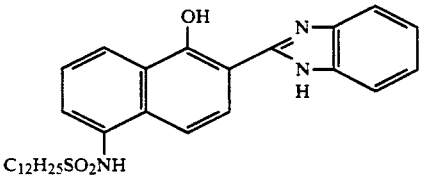
(A-61)
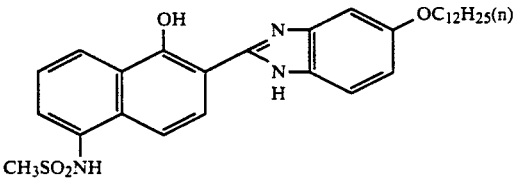
(A-62)
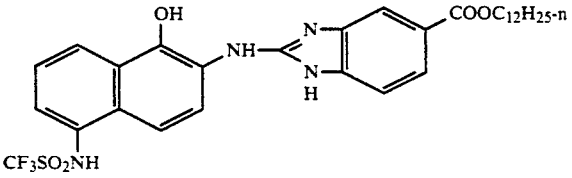

-continued
(A-63)
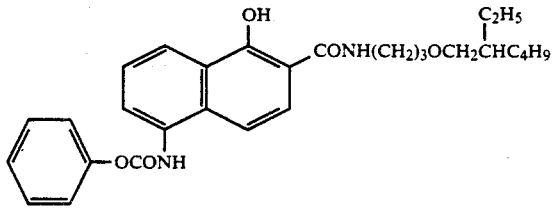
(A-64)
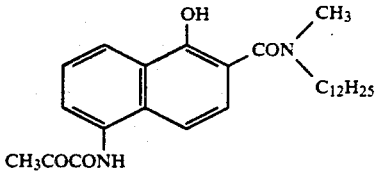
(A-65)
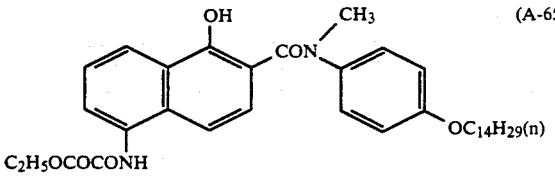
(A-66)
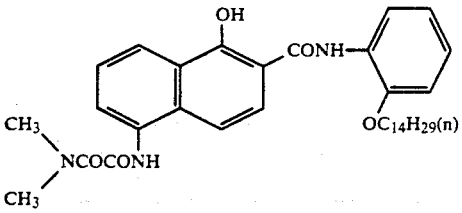
(A-67)
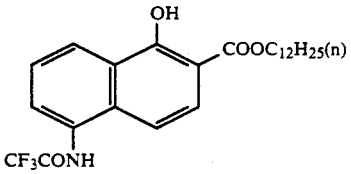
(A-68)
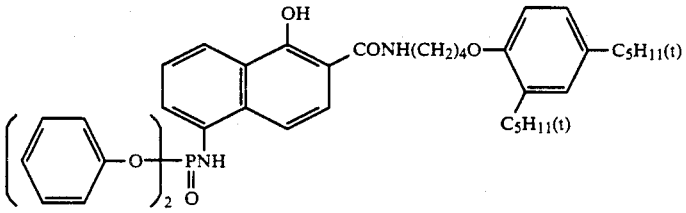
(A-69)
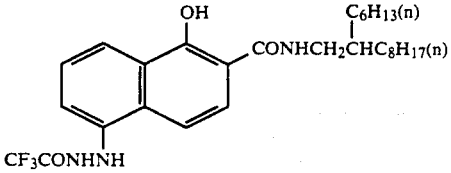
(A-70)
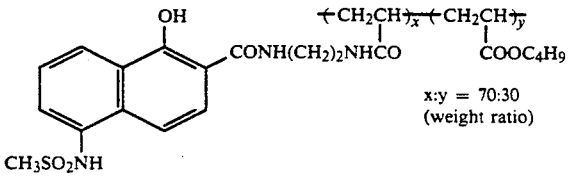
(A-71)
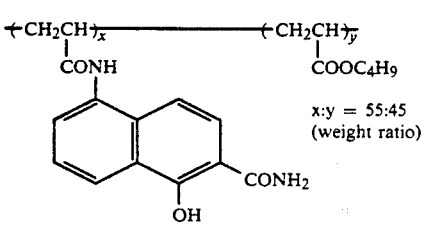
(A-72)
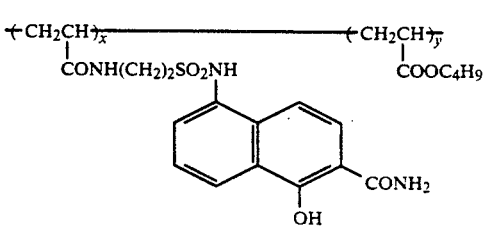
x:y = 80:20
(weight ratio)

-continued

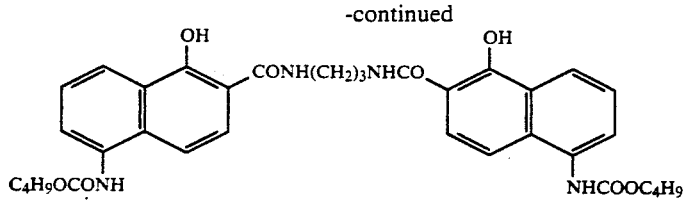

(A-73)

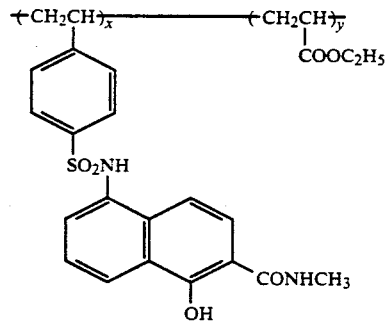

x:y = 60:40
(weight ratio)

(A-74)

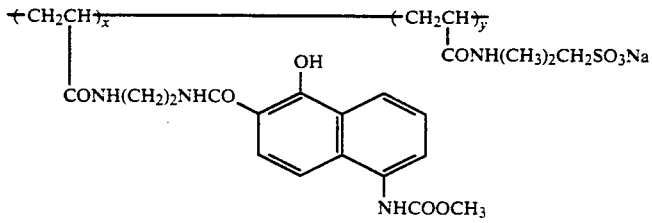

x:y = 50:50
(weight ratio)

(A-75)

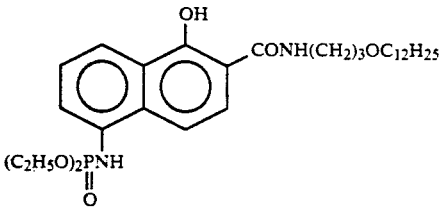

A-76

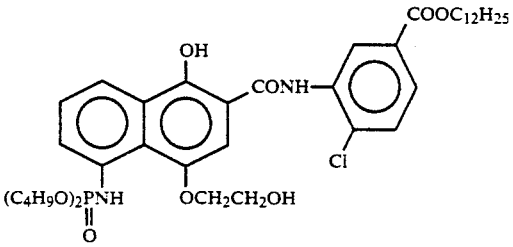

A-77

The cyan couplers represented by general formula (A) can be easily synthesized using the method given in European Patent No. 161,626A.

The cyan couplers represented by general formula (A) of this invention are added to the red-sensitive emulsion layer and/or layers adjacent thereto, and the total added amount is 0.01 to 1.5 g/m$^2$, preferably 0.1 to 1.2 g/m$^2$ and more preferably 0.2 to 1.0 g/m$^2$. In this invention, it is preferable that the red-sensitive emulsion layer is composed of two or more layers having different sensitivities, and of the cyan couplers of this invention, it is preferable to use a 4-equivalent coupler in which T is a hydrogen atom in a low sensitive layer and it is preferable-to use a 2-equivalent coupler in which T is not a hydrogen atom in a high sensitive layer. The method of adding the cyan coupler of this invention to the photosensitive material is in accordance with the methods for the other couplers given below but the amount of the high-boiling organic solvent used as the dispersion solvent with respect to the cyan coupler is, as a weight ratio, preferably 0 to 1.0, more preferably 0 to 0.5 and particularly preferably 0 to 0.3.

The bleaching solution for use in the present invention contains a (1,3-diaminopropanetetraacetato)iron(III) complex salt, and the addition amount of the above complex in the solution is at least 0.2 mol/liter. For the purpose of shortening the processing time, the addition amount is preferably at least 0.25 mol/liter, and more preferably at least 0.3 mol/liter. However, too much of the complex interferes with the bleaching reaction, such that the upper limit of the complex in the bleaching solution is 0.5 mol/liter. The (1,3-diaminopropane-tetraacetato)iron(III) complex salt can be used in the form of an ammonium, sodium or potassium salt, and the ammonium salt thereof, is most preferred with respect to increased bleaching rate. If the amount of the (1,3-diaminopropanetetraacetato)iron(III) complex salt in the bleaching solution is less than 0.2 mol/liter, the bleaching rate is noticeably reduced and the degree of stain formed in the processed material increases. The content of the complex must be at least 0.2 mol/liter according to the method of the present invention.

Next, the effect of the pH value of the bleaching solution for use in the present invention is described as follows.

A bleaching solution containing a (1,3-diaminopropanetetraacetato)iron(III) complex salt and having a pH value of 6 has been proposed in the above-noted JP-A-62-222252. Hitherto, the pH value of an amino-polycarboxylate/ferric complex-containing bleaching solution has been conventionally set to about 6 from both the aspects of ensuring a sufficient bleaching rate and of preventing recoloring failure of cyan dyes. If the pH value of the bleaching solution is lowered, the bleaching rate would be accelerated, but recoloration of the cyan dyes would be insufficient. Accordingly, the optimum setting of the pH has been said to be about 6.

Contrary to conventional practice, the pH value of the bleaching solution is set at 5.5 or less in accordance with the method of the present invention, whereby the effect of the present invention is attained. Specifically, rapid desilvering and complete recoloration of cyan dyes is attained by the method of the present invention, and the above-noted conflicting problem in the prior art is thus overcome by the present invention. Particularly, the pH value of the bleaching solution for use in the method of the present invention is from 5.5 to 2.5. The preferred pH range which more effectively expresses the effect of the present invention is from 5.0 to 3.0, and more preferably from 4.5 to 3.5. For adjusting the pH range, an organic acid such as acetic acid, citric acid or malonic acid or an inorganic acid such as hydrochloric acid, sulfuric acid, nitric acid or phosphoric acid can be used. In particular, acids having an acid dissociation constant (pKa) of from 2.5 to 5.5 are preferred as having a buffering property in the pH range of the present invention. Such acids include, for example, the above-noted acetic acid, citric acid and malonic acid, and additionally benzoic acid, formic acid, butyric acid, malic acid, tartaric acid, oxalic acid, propionic acid, phthalic acid and the like organic acids. Acetic acid is most preferred among them.

The amount of the acid to be used for adjusting the pH is preferably from 0.1 to 2 mols, and more preferably from 0.5 to 1.5 mols, per liter of the bleaching solution.

The bleaching solution preferably contains 1,3-diaminopropane-tetraacetic acid in an amount somewhat greater than the amount necessary for complex formation with ferric ion. Generally, the content of the 1,3-diaminopropane-tetraacetic acid in the bleaching solution is preferably in excess within the range of from 1 to 10 mol %.

The bleaching solution for use in the present invention can contain amino-polycarboxylate/ferric complexes other than a (1,3-diaminopropanetetraacetato)iron(III) complex salt, or in addition to the (1,3-diaminopropanetetraacetato)iron(III) complex salt. Such additional complexes include, for example, ferric complexes of ethylenediaminetetraacetates, diethylenetriaminepentaacetates and cyclohexanediaminetetraacetates.

The bleaching solution for use in the present invention may contain various bleaching accelerators.

Bleaching accelerators for use in the method of the present invention include, for example, the mercapto group- or disulfido group-containing compounds described in U.S. Pat. No. 3,893,858, West German Patent 1,290,812, British Patent 1,138,842, JP-A-53-95630 and *Research Disclosure,* Item No. 17129 (July, 1978); the thiazolidine derivatives as described in JP-A-50-140129; the thiourea derivatives as described in U.S. Pat. No. 3,706,561; iodides described in JP-A-58-16235; the polyethyleneoxides as described in West German Patent 2,748,430; and the polyamine compounds as described in JP-B-45-8836. (The term "JP-B" as used herein means an "examined Japanese patent publication".) The mercapto compounds described in British Patent 1,138,842 are especially preferred.

The bleaching solution for use in the present invention may contain, in addition to the bleaching agent and the above-described compounds, a re-halogenating agent, for example, bromides such as potassium bromide, sodium bromide or ammonium bromide, or chlorides such as potassium chloride, sodium chloride or ammonium chloride. The concentration of the re-halogenating agent in the solution is from 0.1 to 5 mols/liter, and preferably from 0.5 to 3 mols/liter.

In addition, the bleaching solution preferably contains ammonium nitrate as a metal corrosion inhibitor.

According to the method of the present invention, the amount of the bleaching solution that is replenished is from 50 ml to 2000 ml, and preferably from 100 ml to 1000 ml, per $m^2$ of the photographic material processed.

In actual photographic processing with the bleaching solution of the present invention, the solution is aerated so as to oxidize the 1,3-diaminopropane-tetraacetato/ferrous complex salt formed therein.

After bleaching, the photographic material is successively fixed. The fixing is conducted by using a processing solution having a fixing ability (e.g., fixing solution, bleach-fixing solution). The fixing agents for use in the fixing step include thiosulfates such as sodium thiosulfate, ammonium thiosulfate, ammonium sodium thiosulfate and potassium thiosulfate, thiocyanates such as sodium thiocyanate, ammonium thiocyanate and potassium thiocyanate, thioureas, thioethers and the like.

Above all, ammonium thiosulfate is preferably used, and the amount of the agent in the fixing solution is from 0.3 to 3 mols/liter, and preferably from 0.5 to 2 mols/liter.

Furthermore, from the point of view of fixing acceleration, it is preferable to use conjointly the above-mentioned ammonium thiocyanate., thioureas and thioethers (for example, 3,6-dithia-1,8-octanediol), and the amount of these compounds which are used conjointly is greatly 0.01 to 0.1 mol per liter of fixing solution, but, on occasion, it is possible to greatly increase the fixing acceleration effect by using 1-3 mols.

The fixing solution can contain, as a preservative, sulfites such as sodium sulfite, potassium sulfite or ammonium sulfite, as well as hydroxylamine, hydrazine or aldehyde/sulfite adducts such as acetaldehyde/sodium sulfite adduct. In addition, it may further contain various brightening agents, anti-foaming agents and surfactants as well as organic solvents such as polyvinyl pyrrolidone or methanol. In particular, the sulfinic acid compounds described in JP-A-62-143048 are preferred as preservatives.

According to the method of the present invention, the amount of the fixing agent that is replenished is preferably from 300 ml to 3000 ml, and more preferably from 300 ml to 1000 ml, per $m^2$ of the photographic material processed.

The fixing solution for use in the present invention preferably contains various amino-polycarboxylic acids and organic phosphonic acids for the purpose of stabilizing the fixing solution.

The total of the time for the desilvering step, including bleaching and fixing or a combined bleach/fixing step, in the method of the present invention is preferably shortened such that the effect of the present invention is attained more advantageously. The preferred time for the desilvering step is from 1 to 4 minutes, and more preferably from 1 minute and 30 seconds to 3 minutes. The processing temperature is from 25° C. to 50° C., and preferably from 35° C. to 45° C. In the preferred temperature range, the desilvering rate is improved, and generation of stains in the processed material is effectively inhibited.

In the desilvering step of the present invention, the baths are stirred as much as possible in order to attain the effect of the present invention more efficiently.

A specific means for enhancing stirring in the processing steps of the present invention include a method of running a jet stream of the processing solution against the emulsion surface of the photographic material being processed as described in JP-A-62-183460 and JP-A-62-183461; a method of using a rotary means so as to elevate the stirring effect as described in JP-A-62-183461; a method of moving the photographic material being processed while keeping a wiper blade, as provided in the processing bath, in contact with the emulsion surface of the material, whereby the flow of the processing solution over the emulsion surface is made turbulent to improve the stirring effect; and a method of increasing the circulating flow of the total processing solution. Such stirring enhancement means are effective in anyone of the bleaching bath, bleach-fixing bath and fixing bath. The enhancement of stirring is thought to accelerate the rate of applying the bleaching agent and fixing agent to the emulsion film of the photographic material being processed, with a resulting acceleration of the desilvering speed.

The above-noted stirring enhancement means are more effective when a bleaching accelerator is added to the processing solution. Accordingly, the acceleration effect is extremely enhanced and the fixation inhibiting action of the bleaching accelerator is retarded.

The automatic developing machine for use for carrying out the method of the present invention preferably has a photographic material-conveying means as described in JP-A-60-191257, JP-A-60-191258 and JP-A-60-191259. As described in JP-A-60-191257, the conveying means has a noticeable advantage in that the amount of the carry-over of the processing solution to the next bath is extremely reduced such that deterioration of the processing solution is prevented. Such an advantageous effect is especially convenient for shortening the processing time in the respective processing steps and for reducing the amount of the replenisher of the processing solution.

The effect of the present invention becomes more noticeable as the total processing time (i.e., developing, bleaching and fixing) is shortened. Particularly, the effect is noticeable when the total processing time is 8 minutes or less. When the time is 7 minutes or less, the superiority of the method of the present invention to the conventional processing method is pronounced. Accordingly, in practice of the method of the present invention, the total processing time is preferably 8 minutes or less, and more preferably 7 minutes or less.

The color developer for use in the present invention contains a known aromatic primary amine color-developing agent. Preferred examples of the developing agents for use in the present invention are given below, which, however, are not intended, to limit the present invention.

D-1: N,N-diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-(methanesulfonamido)-ethyl]-aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11 4-Amino-3-methyl-N-ethyl-N-β-butoxyethylaniline Among the above-mentioned p-phenylenediamine derivatives, D-5 is especially preferred.

These p-phenylenediamine derivatives may be in the form of salts such as sulfates, hydrochlorides, sulfites or p-toluenesulfonates. The amount of the aromatic primary amine developing agent to be contained in the developer is preferably from about 0.1 g/liter to about 20 g/liter, more preferably from about 0.5 g/liter to about 10 g/liter.

The color developer may contain, as a preservative, sulfites such as sodium sulfite, potassium sulfite, sodium bisulfite, potassium bisulfite, sodium metasulfite or potassium metasulfite, as well as carbonyl-sulfite adducts, if desired.

The preferred amount of the preservative to be added to the color developer is from 0.5 to 10 g/liter, and more preferably from 1 to 5 g/liter.

Compounds capable of directly preserving the above-mentioned color developing agents are preferably added to the agents, and such compounds include, for example, various hydroxylamines, and hydroxamic acids as described in JP-A-63-43138, hydrazines and hydrazides as described in U.S. Pat. No. 4,801,521, phenols as described in JP-A-63-44657, and JP-A-63-58443, α-hydroxyketones and α-aminoketones as described in JP-A-63-44656 and/or various saccharides as described in JP-A-63-36244. Further, monoamides are preferably added as described in JP-A-63-4235, JP-A-63-24254, JP-A-63-21647, JP-A-63-146040, JP-A-63-27841, and JP-A-63-25654, diamines as described in JP-A-63-30845, JP-A-63-146040, and JP-A-63-43139, polyamines as described in JP-A-63-21647 and JP-A-63-26655, polyamines as described in JP-A-63-44655, nitroxy radicals as described in JP-A-63-53551, alcohols described in JP-A-63-43140 and JP-A-53549, oximes as described in JP-A-63-56654, and tertiary amines as described in EP 266797A2, to the color developer for use in the present invention, in combination with the above-mentioned preservative compounds.

Other preservatives which can optionally be added to the color developer for use in the present invention include, for example, various kinds of metals as described in JP-A-57-44148, and JP-A-57-53749, salicylic acids as described in JP-A-59-180588, alkanolamines as described in JP-A-54-3532, polyethyleneimines as described in JP-A-56-94349, and aromatic polyhydroxy compounds as described in U.S. Pat. No. 3,746,544. In particular, the addition of aromatic polyhydroxy compounds is preferred.

The color developer for use in the present invention preferably has a pH value of from 9 to 12, and more preferably from 9 to 11.0. The color developer can contain other various known compounds which constitute conventional developers.

In order to maintain the above pH range, buffers are preferably used.

Specific examples of buffers for use in adjusting the pH of the color developer include, for example, sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicyrate) and potassium 5-sulfo-2-hydroxybenzoate (potassium 5-sulfosalicylate). However, these examples are not whatsoever limiting.

The amount of the buffer to be added to the color developer is preferably 0.1 mol/liter or more, and more preferably from 0.1 mol/liter to 0.4 mol/liter.

In addition, the color developer can contain various chelating agents for preventing the precipitation of calcium or magnesium or for the purpose of improving the stability of the color developer.

The chelating agent are preferably organic compounds, and include, for example, aminopolycarboxylic acids, organic phosphonic acids and phosphonocarboxylic acids. Specific non-limiting examples of the compounds are given below as follows.

Nitrilotriacetic acid, diethylenetriamine-pentaacetic acid, ethylenediamine-tetraacetic acid, N,N,N-trimethylenephosphonic acid, ethylenediamine-N,N,N',N'-tetramethylenephosphonic acid, trans-cyclohexanediaminetetraacetic acid, 1,2-diaminopropane-tetraacetic acid, hydroxyethyliminodiacetic acid, glycolether-diaminetetraacetic acid, ethylenediamine-orthohydroxyphenylacetic acid, 2-phosphonobutane-1,2,4-tricarboxylic acid, 1-hydroxyethylidene-1,1-diphosphonic acid, N,N[-bis(2-hydroxybenzyl)ethylenediamine-N,N'-diacetic acid.

These chelating agents can be used in combination of two or more, if desired.

The amount of the chelating agent to be added is such that it is sufficient to sequester the metal ion in the color developer. For example, it is from about 0.1 to 10 g/liter.

The color developer can contain, if desired, conventional development accelerators. However, it is preferred that the color developer for use in the present invention does not substantially contain benzyl alcohol with regard to environmental factors, easy preparation of the color developer and prevention of color staining in the processed photographic material. The terminology "does not substantially contain benzyl alcohol" as referred to herein means that the color developer contains benzyl alcohol in an amount of 2 ml/liter or less, but preferably does not contain any benzyl alcohol.

Other development accelerators which can be used in the present invention include, for example, thioether compounds as described in JP-B-37-16088, JP-B-37-5987, JP-B-38-7826, JP-B-44-12380, JP-B-45-9019 and U.S. Pat. No. 3,813,247; p-phenylenediamine compounds as described in JP-A-52-49829 and JP-A-50-15554; quaternary ammonium salts as described in JP-A-50-137726, JP-B-44-30074, JP-A-56-156826 and JP-A-52-43429; amine compounds as described in U.S. Pat. Nos. 2,494,903, 3,128,182, 4,230,796, 3,253,919, JP-B-41-11431, U.S. Pat. Nos. 2,482,546, 2,596,926 and 3,582,346; polyalkyleneoxides as described in JP-B-37-16088, JP-B-42-25201, U.S. Pat. No. 3,128,183, JP-B-41-11431, JP-B-42-23883 and U.S. Pat. No. 3,532,501; as well as other 1-phenyl-3-pyrazolidones and imidazoles.

In the present invention, conventional antifoggants can be added to the color developer, if desired. For example, alkali metal halides such as sodium chloride, potassium chloride or potassium iodide as well as organic antifoggants can be used. Specific examples of useful organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindene and adenine.

The color developer for use in the present invention may contain a brightening agent. The brightening agent is preferably a 4,4'-diamino-2,2'-disulfostilbene compound. The amount of the brightening agent to be added to the color developer is to not exceed 5 g/liter, and is preferably from 0.1 to 4 g/liter.

In addition, the color developer may further contain, if desired, various surfactants such as alkylsulfonic acids, arylphoaphonic acids, aliphatic carboxylic acids and aromatic carboxylic acids.

The processing temperature using the color developer of the present invention is between 20° C. and 50° C., and preferably between 30° C. and 45° C. The developing time is between 20 seconds and 5 minutes, and preferably between 30 seconds and 3 minutes. The amount of the replenisher for the color developer in accordance with the method of the present invention is preferably reduced. Specifically, the replenisher amount is from 100 to 1500 ml, and preferably from 100 to 800 ml, per $m^2$ of the photographic material processed; more preferably, it is from 100 to 400 ml/$m^2$.

The color developing system may comprise two or more baths, if desired, and the color developer replenisher is added to the first bath or to the last bath, whereby the development time is shortened or the replenisher amount is reduced respectively.

The processing method of the present invention can be applied to color reversal processing. As such, a black-and-white first developer is generally used in the conventional color reversal procedure for color photographic materials. A conventional black-and-white developer for use in processing conventional monochromatic (black-and-white) photographic materials can also be employed as the black-and-white developer. The developer can contain various well-known additives which are generally added to conventional black-and-white developers.

Specific examples of usable additives include, for example, a developing agent such as 1-phenyl-3-pyrazolidone, Metol or hydroquinone, a preservative such as a sulfite, an alkali accelerator such as sodium hydroxide, sodium carbonate or potassium carbonate, an inorganic or organic inhibitor such as potassium bromide, 2-methylbenzimidazole or methylbenzothiazole, a water softener such as a polyphosphate, as well as a development inhibitor comprising a trace amount of iodides or mercapto compounds.

The processing method of the present invention comprises the above-described steps of color-development, bleaching, bleach-fixation and fixation. After the bleach-fixing or fixing step, the photographic material is generally rinsed in water or is stabilized. A simplified process may be employed where the photographic material as processed in the bath having a fixability is directly stabilized without substantial rinsing in water.

The rinsing water for use in the rinsing step may contain known additives, if desired. For example, useful additives include a water softeners such as inorganic phosphoric acids, aminopolycarboxylic acids and organic phosphoric acids, a bactericide or fungicide for preventing the propagation of various bacteria and algae (for example, isothiazolone, organic chlorine-containing bactericides and benzotriazole), and a surfactant for preventing drying load and unevenness. In addition, the compounds described in L.E. West *Water Quality Criteria, Phot. Sci. & Eng.*, Vol. 9, No. 6, pages 344 to 359 (1965) can also be used.

As the stabilizing solution for the stabilizing step, a processing solution for stabilizing the formed color image is used. For instance, a solution having a buffering capacity in the range of from pH 3 to pH 6 or an aldehyde (e.g., formalin)-containing solution can be used. The stabilizing solution may contain, if desired, an ammonium compound, a metal (e.g., Bi, Al) compound, a brightening agent, a chelating agent (e.g., 1-hydroxyethylidene-1,1-diphosphonic acid), a bactericide, a fungicide, a hardening agent and a surfactant.

The rinsing step or stabilizing step is preferably effected in a multi-stage countercurrent system, and the number of the stages is preferably from 2 to 4 stages. The amount of the replenisher to the system is from 1 to 50 times, preferably from 2 to 30 times, and more preferably from 2 to 15 times, of the amount of the carry-over from the previous bath per the unit area of the photographic material processed.

The water for use in the water-rinsing step or stabilizing step includes, for example, city water as well as de-ionized water which has been treated with an ion-exchange resin to minimize the Ca and Mg contents to 5 mg/liter or less, or sterilized water which has been treated with a halogen or ultraviolet sterilizer lamp is preferably used.

When the method of the present invention is practiced using an automatic developing machine for continuous processing, the processing solution is often evaporated and thereby concentrated during the continuous procedure. Concentration of the processing solution is especially pronounced when the amount of the processing solution is small or the area of the processing solution open to the ambient is large. In order to compensate for the concentration of the processing solution during the continuous procedure, an appropriate amount of water or a replenisher to the processing system is preferably added.

The over-flown solution from the water-rinsing step or the stabilizing step is preferably returned to the previous bath having a fixing ability, whereby the amount of the waste liquid is reduced.

The photographic material to be processed by the method of the present invention optionally has at least one blue-sensitive, green-sensitive and red-sensitive silver halide emulsion layer on a support, and the number of the silver halide emulsion layers and light-insensitive layers and the order of the layer(s) provided on the support are not restricted. For example, the silver halide photographic material may comprise at least one light-sensitive layer comprising plural silver halide emulsion layers each having substantially the same color-sensitivity, but having a different degree of light sensitivity, provided on a support. Such a light-sensitive layer is a unit color-sensitive layer having a color-sensitivity to any of blue, green, or red light. In a multilayer silver halide color photographic material, in general, the sequence of the unit light-sensitive layers provided on the support comprises a red-sensitive layer, a green-sensitive layer and a blue-sensitive layer, where the blue-sensitive layer is furthest from the support. However, this sequence may be reversed, as the case may be, or a different sequence where a different light-sensitive layer is sandwiched between the same color-sensitive layers may also be employed.

Light-insensitive layers including various interlayers can be provided between the silver halide light-sensitive layers or over the outermost layer or below the lowermost layer.

The interlayers can contain various couplers or DIR compounds as described in JP-A-61-43748, JP-A-59-113438, JP-A-59-113440, JP-A-61-20037 and JP-A-61-20038, or may also contain conventional color mixing preventing agents.

The plural silver halide emulsion layers constituting each unit light-sensitive layer preferably has a two-layer structure comprising a high-sensitivity emulsion layer and a low-sensitivity emulsion layer, as described in West German Patent 1,121,470 or British Patent 923,045. In general, the plural layers are preferably sequenced on the support in such order that the layer closest to the support has a lower degree of sensitivity. A light-insensitive layer may be placed between the respective silver halide emulsion layers. Alternatively, the low-sensitivity emulsion layer of the unit light-sensitive layer may be provided further from the support and the high-sensitivity emulsion layer closer to the support, as described in JP-A-57-112751, JP-A-62-200350, JP-A-62-206541 and JP-A-62-206543.

Examples of the ordering sequence of the layers on the support include a low-sensitivity blue-sensitive layer (BL),high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), where the BL layer is furthest from the support, the order of BH/BL/GL/GH/RH/RL and the order of BH/BL/GH/GL/RL/RH.

Further, the order of blue-sensitive layer/GH/RH/GL/RL where the blue-sensitive layer is furthest from the support, as described in JP-B-55-34932, can also be employed. The order of blue-sensitive layer/GL/RL/GH/RH where the blue-sensitive layer is furthest from the support, as described in JP-A-56-25738 and JP-A-62-63936, can also be employed.

In addition, the ordering sequence described in JP-B-49-15495, where the upper layer is a silver halide emulsion layer of highest sensitivity, the middle layer is a silver halide emulsion layer of intermediate sensitivity, and the lower emulsion layer is of lowest sensitivity, wherein the three layers are provided on the support such that the layer having the lowest sensitivity is closest to the support, can also be employed. A three layer-constitution having the same color-sensitivity may be sequenced on the support in the order of middle-sensitivity emulsion layer/high-sensitivity emulsion layer/-low-sensitivity emulsion layer, where the middle-sensitivity layer is furthest from the support, as described in JP-A-59-202464.

As described above, various layer constitutions and ordering sequences may be selected for preparing the photographic material in accordance with the objects thereof.

The preferred silver halides for use in the photographic emulsion layer in the photographic material processed in accordance with the method of the present invention is silver iodobromide, silver iodochloride or silver iodochlorobromide containing about 30 mol % or less silver iodide. More preferably, the silver halide is silver iodobromide or silver iodochlorobromide containing from about 2 mol % to about 25 mol % of silver iodide.

The silver halide grains in the photographic emulsion may have a regular crystal form such as cubic, octahedral or tetradecahedral, or have an irregular crystal form such as spherical or tabular, or have crystal defects such as twin planes, or may comprise composite crystal forms.

The silver halide grains may comprise fine grains having a grain size of about 0.2 μm or less, or may be large grains having a grain size of up to about 10 μm. The emulsion may be either a polydispersed emulsion or a monodispersed emulsion.

The silver halide photographic emulsion for use in the present invention can be prepared, for example, by the methods described in *Research Disclosure* (RD), Item No. 17643 (December, 1978), pages 22 to 23, *I. Emulsion Preparation and Types;* RD Item No. 18716 (November, 1979), page 648; P. Glafkides, *Chimie et Phisique Photographique* (published by Paul Montel, 1967), G. F. Duffin, *Photographic Emulsion Chemistry* (published by Focal Press, 1966) and V. L. Zelikman et al, *Making and Coating Photographic Emulsion* (published by Focal Press, 1964).

The monodispersed emulsions described in U.S. Pat. Nos. 3,574,628 and 3,655,394 and British Patent 1,413,748 are also preferred for use in the present invention.

Tabular grains having an aspect ratio of about 5 or more can also be used in the present invention. Such tabular grains are readily prepared in accordance with the methods described in Gutoff, *Photographic Science and Engineering,* Vol. 14, pages 248 to 257 (1970), U.S. Pat. Nos. 4,434,226, 4,414,310, 4,433,048 and 4,439,520 and British Patent 2,112,157.

The crystal structure of the grains may be uniform or may comprise halogen compositions which differ between the inside and the outside portions of the grain. Further, the grains may have a layered structure. Other silver halide grain structures for use in the present invention include plural silver halides joined together by an epitaxial junction. The grains may also contain compounds other than silver halides, such as silver rhodanide or lead oxide.

In addition, a mixture of grains of various crystal form may also be used.

The silver halide emulsions for use in the present invention are generally physically-ripened, chemically-ripened or spectrally-sensitized. Additives for use in the ripening or sensitizing steps are described, for example, in RD (Research Disclosure), Item Nos. 17643 and 18716, and relevant parts thereof are listed in the Table below.

Other known photographic additives for use in the present invention are also described, for example, in the above Research Disclosures, and relevant parts thereof are also included in the Table.

| Kind of Additives | RD 17643 | RD 18716 |
|---|---|---|
| 1. Chemical Sensitizer | Page 23 | Page 648, right column |
| 2. Sensitivity-enhancer | | Page 648, right column |
| 3. Spectral Sensitizer, Supersensitizer | Pages 23 to 24 | Page 648, right column to page 649, right column |
| 4. Brightening Agent | Page 24 | |
| 5. Antifoggant and Stabilizer | Pages 24 to 25 | Page 649, right column |
| 6. Light Absorbent, Filter Dye and UV Absorbent | Pages 25 to 26 | Page 649, right column to page 650, left column |
| 7. Stain Inhibitor | Page 25, right column | Page 650, left column to right column |
| 8. Color Image Stabilizer | Page 25 | |
| 9. Hardening Agent | Page 26 | Page 651, left column |
| 10. Binder | Page 26 | Page 651, left column |
| 11. Plasticizer and Lubricant | Page 27 | Page 650, right column |
| 12. Coating Aid and Surfactant | Pages 26 to 27 | Page 650, right column |
| 13. Antistatic Agent | Page 27 | Page 650, right column |

In order to prevent deterioration of the photographic properties by formaldehyde gas, a compound is preferably added to the photographic material which reacts with formaldehyde and immobilize (fix) the same as described in U.S. Pat. Nos. 4,411,987 and 4,435,503.

Various color couplers can be used in the photographic material of the present invention, and examples thereof are described in the patent publication referred to in the above-noted RD, Item No. 17643, VII-C to G.

Yellow couplers preferably used in the material of the present invention include those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649 and European Patent 249,473A.

Of the magenta couplers for use in the present invention, 5-pyrazolone compounds are preferred. Above all, those described in U.S. Pat. Nos. 4,310,619, 4,351,897, European Patent 73,636, U.S. Pat. Nos. 3,061,432, 3,725,064, RD, Item No. 2422 (June, 1984), JP-A-60-33552, RD, Item No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, WO(PCT) 88/04795 are especially preferred.

The following cyan couplers can be used together with the compounds represented by formula (A) of the present invention. Cyan couplers for use in the present invention include phenol couplers and naphthol couplers, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent (OLS) No. 3,329,729, European Patents 121,365A, 249,453A, U.S. Pat. Nos. 3,446,622, 4,333,999, 4,753,871, 4,451,559, 4,427,767, 4,690,889, 4,254,212, 4,296,199 and JP-A-61-42658 are preferred.

Colored couplers for correcting unnecessary absorption of colored dyes can also be used in the material of the present invention, and those described in *Research Disclosure,* Item No. 17643 VII-G, U.S. Pat. No. 4,163,670, JP-B-57-39413, U.S. Pat. Nos. 4,004,929, 4,138,258 and British Patent 1,146,368 are preferred.

Couplers for forming diffusible dyes can also be used in the material of the present invention, and those described in U.S. Pat. No. 4,366,237, British Patent 2,125,570, European Patent 96,570 and West German Patent 3,234,533 are preferred.

Polymerized dye-forming couplers can also be used in the material of the present invention, and specific examples thereof are described in U.S. Pat. Nos. 3,451,820, 4,080,211, 4,367,282, 4,409,320, 4,576,910 and British Patent 2,102,173.

Couplers which release a photographically useful residua upon coupling are also preferably used in the material of the present invention. As development inhibitor-releasing DIR couplers for use in the material of the present invention, those described in the patent publications referred to in the above-noted *Research Disclosure,* Item No. 17643, VII-F as well as those described in JP-A-57-151944, JP-A-57-154234, JP-A-60-184248, JP-A-63-37346 and U.S. Pat. No. 4,248,962 are preferred.

Of the couplers which imagewise release a nucleating agent or a development accelerator during development, for use in the material of the present invention, those described in British Patents 2,097,140, 2,131,188, JP-A-59-157638 and JP-A-59-170840 are preferred.

In addition, other couplers for use in the photographic materials of the present invention include competing couplers as described in U.S. Pat. No. 4,130,427, poly-valent couplers as described in U.S. Pat. Nos. 4,238,472, 4,338,393 and 4,310,618, DIR redox compound-releasing couplers, DIR coupler-releasing couplers, DIR coupler-releasing redox compounds or DIR redox compound-releasing redox compounds as described in JP-A-60-185950 and JP-A-62-25252, couplers which release dyes which recolor after release as described in European Patent 173,302A, bleaching accelerator-releasing couplers as described in *Research Disclosure,* Item Nos. 11449 and 24241 and JP-A-61-201247, ligand-releasing couplers as described in U.S. Pat. No. 4,553,477 and leuco dye-releasing couplers as described in JP-A-63-75747.

The above-described couplers can be incorporated into the photographic material of the present invention by various known dispersion methods.

For instance, an oil-in-water dispersion method may be thus employed, and examples of high boiling point solvents useful in the oil-in-water dispersion method are described in U.S. Pat. No. 2,322,027.

Specific examples of high boiling point organic solvents having a boiling point at atmospheric pressure of 175° C. or more for use in the oil-in-water dispersion method include phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate); phosphates or phosphonates (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphonate); benzoates (e.g., 2-ethylhexyl benzoate, dodecyl benzoate, 2-ethylhexyl-p-hydroxybenzoate); amides (e.g., N,N-diethyldecanamide, N,N-diethyllaurylamide, N-tetradecylpyrrolidone); alcohols or phenols (e.g., isostearyl alcohol, 2,4-di-tert-amylphenol), aliphatic carboxylic acid esters (e.g., bis(2-ethylhexyl) sebacate, dioctyl azelate, glycerol tributyrate, isostearyl lactate, trioctyl citrate); aniline derivatives (e.g., N,N-dibutyl-2-butoxy-5-tertoctylaniline); and hydrocarbons (e.g., paraffin, dodecylbenzene, diisopropylnaphthalene). As auxiliary solvents, organic solvents having a boiling point of about 30° C. or higher, preferably from 50° C. to about 160° C. are useful. Specific examples thereof include ethyl acetate, butyl acetate, ethyl propionate, methyl ethyl ketone, cyclohexanone, 2-ethoxyethyl acetate and dimethylformamide.

A latex dispersion method can also be employed, and the step and the effect of the method as well as examples of latexes for use in the impregnation step of the latex method are described in U.S. Pat. No. 4,199,363 and West German Patent Application (OLS) Nos. 2,541,274 and 2,541,230.

The method of the present invention can be applied to various color photographic materials. Specific examples include color negative film for general use and for movie applications, color reversal film for slides or television, color papers, color positive films and color reversal papers.

Supports which are suitably used in the material of the present invention include those described in, for example, the above-noted *Research Disclosure,* Item No. 17643, page 28 and *Research Disclosure,* Item No. 18716, from page 647, right-hand column to page 648, left-hand column.

The photographic materials for processing by the method of the present invention are preferably such that the sum of the thickness of each of the hydrophilic colloid layers on the side of the support having the emulsion layers is 28 μm or less, and the film swelling speed ($T_{\frac{1}{2}}$) is 30 seconds or less. The thickness of the layers is that measured at a temperature of 25° C. and a relative humidity of 55% (conditioned for 2 days), and the film swelling speed ($T_{\frac{1}{2}}$) is determined by a conventional technical means. For instance, the film swelling speed can be determined by the use of a swellometer of the type described in A. Green, *Photographic Science & Engineering,* Vol. 19, No. 2, pages 124 to 129. In a measurement using a swellometer, the saturated film thickness corresponds to 90% of the maximum swollen film thickness achieved when the material has been processed with a color developer at 30° C. for 3 minutes and 15 seconds, and $T_{\frac{1}{2}}$ is defined to be the time required to achieve the half of the saturated film thickness.

The film swelling speed ($T_{\frac{1}{2}}$) can be adjusted by adding a hardening agent to a gelatin binder, or by varying the condition of storage of the coated material.

The swelling percentage is preferably from 150 to 400%. The swelling percentage is calculated as the (maximum swollen film thickness-film thickness)/(film thickness), using the maximum swollen film thickness determined under the above-noted conditions.

The silver halide color photographic materials for use in the present invention may contain a color developing agent for the purpose of simplifying and accelerating the photographic processing of the materials. For incorporating the agent, various precursors of color developing agents are preferably used. For example, useful precursors include indoaniline compounds as described in U.S. Pat. No. 3,342,597, Schiff base compounds as described in U.S. Pat. No. 3,342,599 and *Research Disclosure,* Item No. 14850 and 15159, aldol compounds as described in *Research Disclosure,* Item No. 13924, metal salt complexes as described in U.S. Pat. No. 3,719,492 and urethane compounds as described in JP-A-53-135628.

The silver halide color photographic materials for use in the present invention can contain, if desired, various 1-phenyl-3-pyrazolidones for accelerating color developability.

Specific examples of such compounds are described in JP-A-56-64339, JP-A-57-144547 and JP-A-58-115438.

The temperature of the processing solutions for use in the method of the present invention, may be elevated to accelerate processing and to shorten the processing time, or on the contrary, the temperature may be lowered to improve the quality of the image formed or to improve the stability of the processing solutions. For the purpose of economizing silver employed in the photographic materials of the present invention, the technique of cobalt intensification or hydrogen peroxide intensification as described in West German Patent 2,226,770 or U.S. Pat. No. 3,674,499 can be employed.

The method of the present invention can further be applied to heat-developable photographic materials as described in U.S. Pat. No. 4,500,626, JP-A-60-133449, JP-A-59-218443, JP-A-61-238056 and European Patent 210,660A2.

The following non-limiting examples illustrate the present invention in detail.

EXAMPLE 1

Plural layers each having the composition mentioned below were provided on a cellulose triacetate film support coated with a subbing layer to prepare a multilayer color photographic material (Sample No. 101).

The compositions of the layers are described below. The amount coated is represented by units of g(silver)/m$^2$ for colloidal silver and silver halide, by units of g/m$^2$ for couplers, additives and gelatin, and by unit of mol per mol of silver halide present in the same layer for the sensitizing dyes. Additives are represented by their abbreviations as given below. Where one additive compound has plural effects, one of these effects is described as a representative.

UV; Ultraviolet Absorbent
Solv; High Boiling Point Organic Solvent
ExF; Dye
ExS; Sensitizing Dye
ExC; Cyan Coupler
ExM; Magenta Coupler
ExY; Yellow Coupler
Cpd; Additive.

| | |
|---|---|
| First Layer: Anti-halation Layer | |
| Black Colloidal Silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| Second Layer: Low-sensitivity Red-sensitive Emulsion Layer | |
| Silver Iodobromide Emulsion (AgI 4 mol %; uniform AgI type; Sphere-corresponding diameter 0.4 μm; fluctuation coefficient of sphere-corresponding diameter 37%; tabular grains; ratio of diameter/thickness 3.0) | 0.4 as Ag |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |

-continued

| | |
|---|---|
| ExC-1 | 0.17 |
| ExC-2 | 0.03 |
| ExC-3 | 0.13 |
| Third Layer: Middle-sensitivity Red-sensitive Emulsion Layer | |
| Silver Iodobromide Emulsion (AgI 6 mol %; AgI-rich core type; core/shell grains with core/shell ratio of 2/1; Sphere-corresponding diameter 0.65 μm; fluctuation coefficient of sphere-corresponding diameter 25%; tabular grains; ratio of diameter/thickness 2.0) | 0.65 as Ag |
| Silver Iodobromide Emulsion (AgI 4 mol %; uniform AgI type; Sphere-corresponding diameter 0.4 μm; fluctuation coefficient of sphere-corresponding diameter 37%; tabular grains; ratio of diameter/thickness 3.0) | 0.1 as Ag |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |
| Fourth Layer: High-sensitivity Red-sensitive Emulsion Layer | |
| Silver Iodobromide Emulsion (AgI 6 mol %; AgI-rich core type; core/shell ratio of 2/1; Sphere-corresponding diameter 0.7 μm; fluctuation coefficient of sphere-corresponding diameter 25%; tabular grains; ratio of diameter/thickness 2.5) | 0.9 as Ag |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |
| Fifth Layer: Interlayer | |
| Gelatin | 0.6 |
| UV-4 | 0.03 |
| UV-5 | 0.04 |
| Cpd-1 | 0.1 |
| Polyethyl Acrylate Latex | 0.08 |
| Solv-1 | 0.05 |
| Sixth Layer: Low-sensitivity Green-sensitive Emulsion Layer | |
| Silver Iodobromide Emulsion (AgI 4 mol %; uniform AgI type; Sphere-corresponding diameter 0.4 μm; fluctuation coefficient of sphere-corresponding diameter 37%; tabular grains; ratio of diameter/thickness 2.0) | 0.18 as Ag |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |
| Seventh Layer: Intermediate-sensitivity Green-sensitive Emulsion Layer | |
| Silver Iodobromide Emulsion (AgI 4 mol %; AgI-rich shell type with core/shell ratio of 1/1; sphere-corresponding diameter 0.5 μm; fluctuation coefficient of sphere-corresponding diameter | 0.27 as Ag |

-continued

| | |
|---|---|
| 20%; tabular grains; ratio of diameter/thickness 4.0) | |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| Eighth Layer: High-sensitivity Green-sensitive Emulsion Layer | |
| Silver Iodobromide Emulsion (AgI 8.7 mol %; multi-layered grains with silver ratio of 3/4/2; AgI content ratio of 24 mol %/0 mol %/ 3 mol % in order from the inside core; sphere-corresponding diameter 0.7 μm; fluctuation coefficient of sphere-corresponding diameter 25%; tabular grains; ratio of diameter/ thickness 1.6) | 0.7 as Ag |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |
| Ninth Layer: Interlayer | |
| Gelatin | 0.6 |
| Cpd-1 | 0.04 |
| Polyethyl Acrylate Latex | 0.12 |
| Solv-1 | 0.02 |
| Tenth Layer: Interlayer Effect Donor Layer to Red-sensitive Layer | |
| Silver Iodobromide Emulsion (AgI 6 mol %; AgI-rich core type with core/shell ratio of 2/1; sphere-corresponding diameter 0.7 μm; fluctuation coefficient of sphere-corresponding diameter 25%; tabular grains; ratio of diameter/ thickness 2.0) | 0.68 as Ag |
| Silver Iodobromide Emulsion (AgI 4 mol %; uniform AgI type; Sphere-corresponding diameter 0.4 μm; fluctuation coefficient of sphere-corresponding diameter 37%; tabular grains; ratio of diameter/ thickness 3.0) | 0.19 as Ag |
| Gelatin | 1.0 |
| ExS-3 | $6 \times 10^{-4}$ |
| ExM-10 | 0.19 |
| Solv-1 | 0.20 |
| Eleventh Layer: Yellow Filter Layer | |
| Yellow Colloidal Silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |

-continued

| | |
|---|---|
| Twelfth Layer: Low-sensitivity Blue-sensitive Emulsion Layer | |
| Silver Iodobromide Emulsion (AgI 4.5 mol %; uniform AgI type; Sphere-corresponding diameter 0.7 μm; fluctuation coefficient of sphere-corresponding diameter 15%; tabular grains; ratio of diameter/ thickness 7.0) | 0.3 as Ag |
| Silver Iodobromide Emulsion (AgI 3 mol %; uniform AgI type; Sphere-corresponding diameter 0.3 μm; fluctuation coefficient of sphere-corresponding diameter 30%; tabular grains; ratio of diameter/ thickness 7.0) | 0.15 as Ag |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| Thirteenth Layer: Interlayer | |
| Gelatin | 0.7 |
| ExY-12 | 0.20 |
| Solv-1 | 0.34 |
| Fourteenth Layer: High-sensitivity Blue-sensitive Emulsion Layer | |
| Silver Iodobromide Emulsion (AgI 10 mol %; AgI-rich core type; Sphere-corresponding diameter 1.0 μm; fluctuation coefficient of sphere-corresponding diameter 25%; multi-layer twin-plane tabular grains; ratio of diameter/thickness 2.0) | 0.5 as Ag |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| Fifteenth Layer: First Protective Layer | |
| Fine Silver Iodobromide Grain Emulsion (AgI 2 mol %; uniform AgI type; sphere-corresponding diameter 0.07 μm) | 0.12 as Ag |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethyl acrylate Latex | 0.09 |
| Sixteenth Layer: Second Protective Layer | |
| Fine Silver Iodobromide Grain Emulsion (AgI 2 mol %; uniform AgI type; sphere-corresponding diameter 0.07 μm) | 0.36 as Ag |
| Gelatin | 0.55 |
| Polymethyl Methacrylate Grains (diameter 1.5 μm) | 0.2 |
| H-1 | 0.17 |

Emulsion stabilizer (Cpd-3) (0.07 g/m$^2$) and surfactant (Cpd-4) (0.03 g/m$^2$) were added as coating aids to the first to sixteenth layers, in addition to the above-mentioned components.

The compounds listed above are described below as follows:

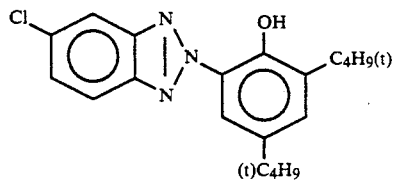

UV-1

-continued
UV-2
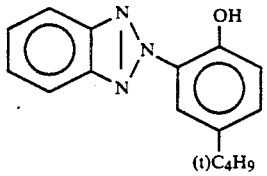
UV-3
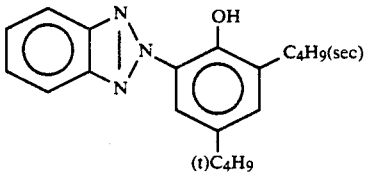
UV-4
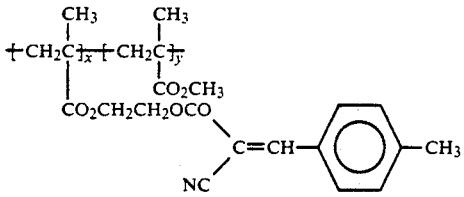
x:y = 70:30 (wt %)
UV-5
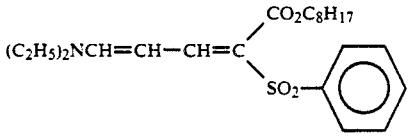
Tricresyl Phosphate — Solv-1
Dibutyl Phthalate — Solv-2
Solv-4
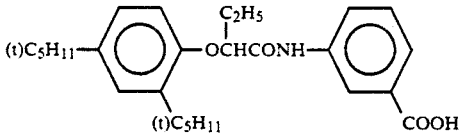
Trihexyl Phosphate — Solv-5
ExF-1
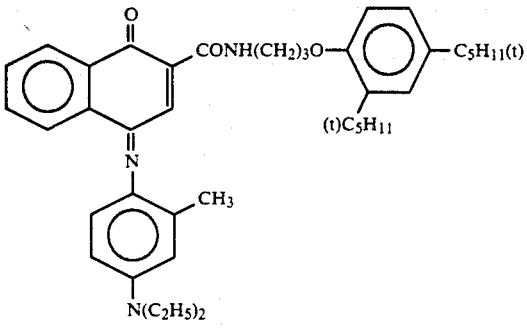

-continued
ExF-2
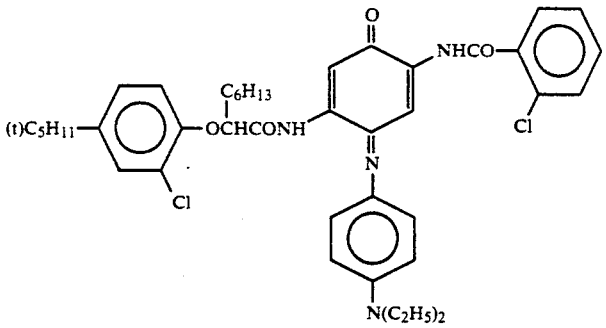
ExS-1
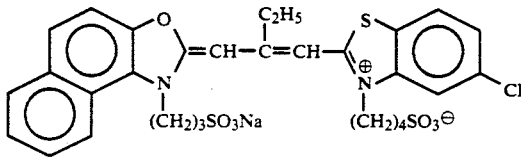
ExS-2
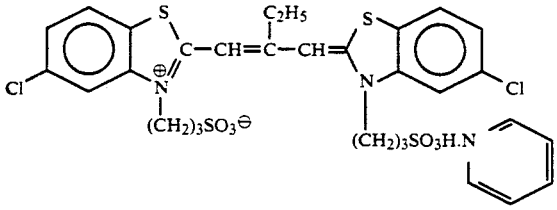
ExS-3
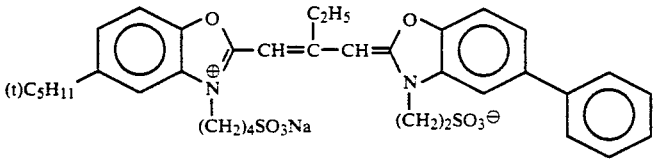
ExS-4
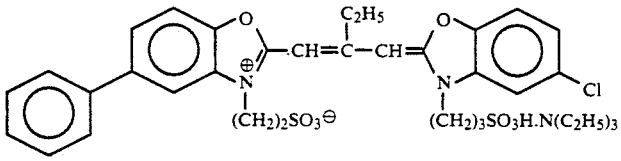
ExS-5
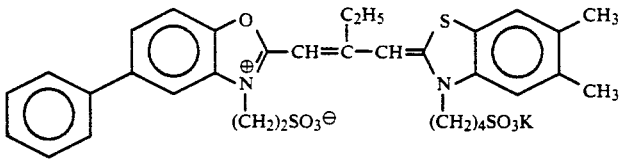
ExS-6
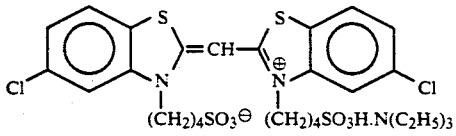
ExS-7
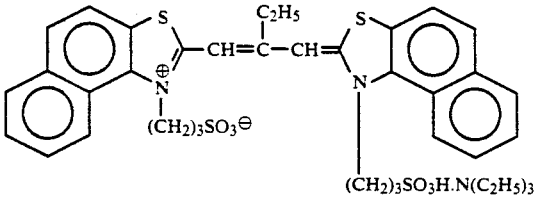

-continued
ExS-8
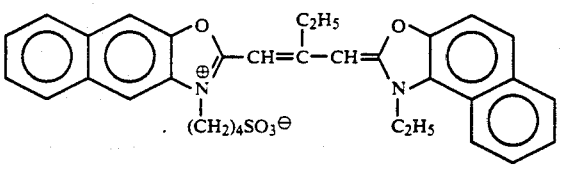
ExC-1
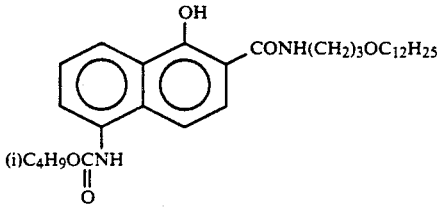
ExC-2
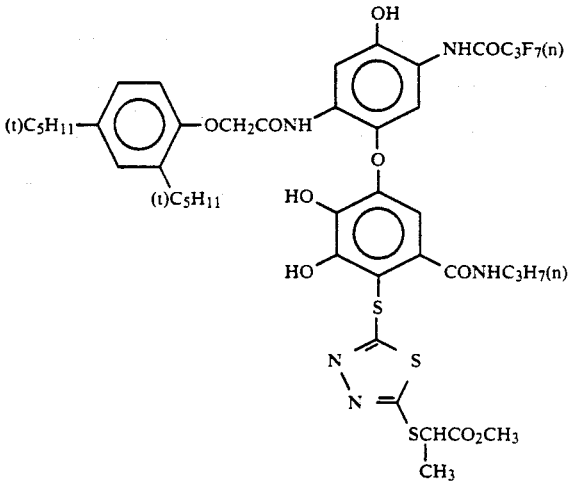
ExC-3
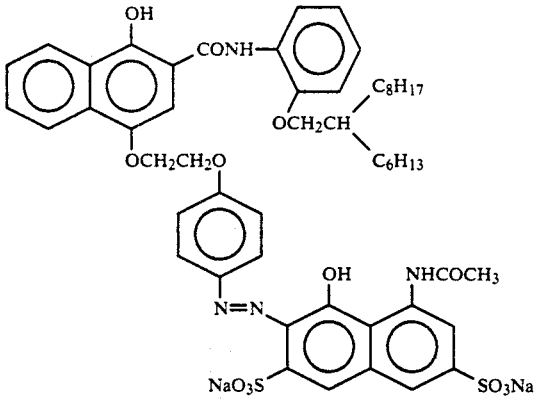
ExC-4
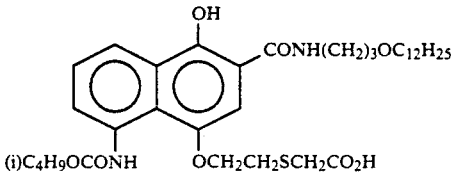

-continued
FxM-5
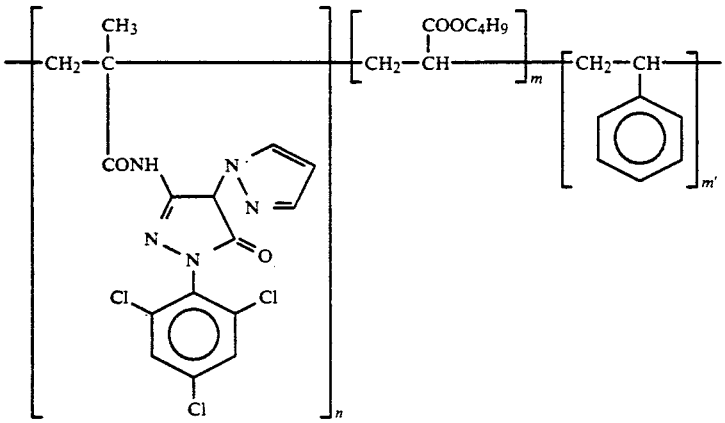
n = 50
m = 25
m′ = 25 (by mol)
mol. wt. ca. 20,000
FxM-6
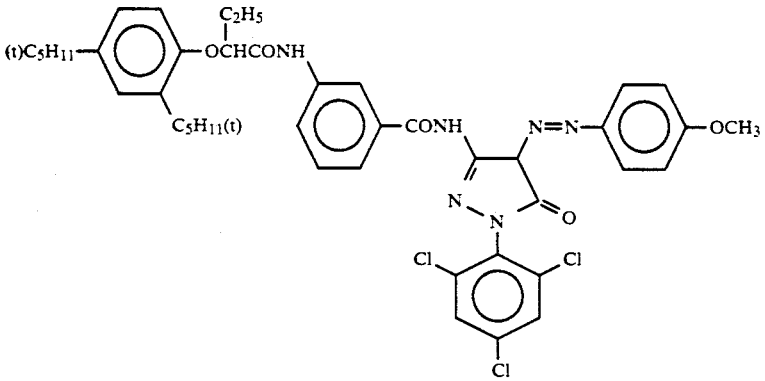
ExM-7
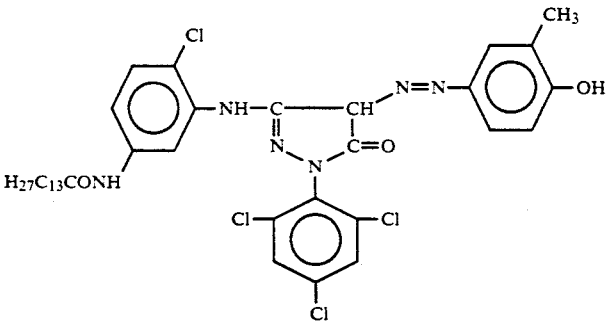
ExM-10
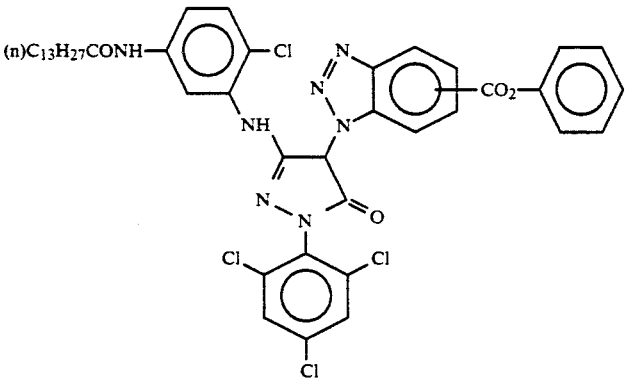

-continued
ExY-8
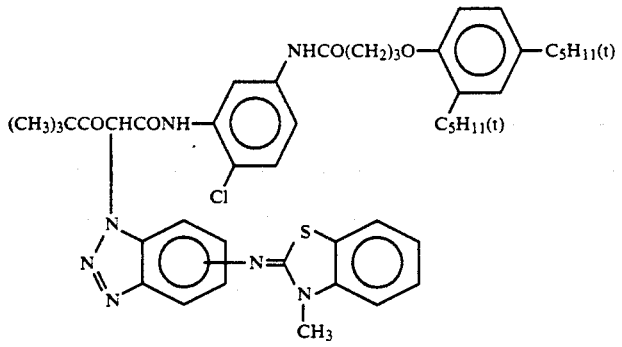
ExY-9
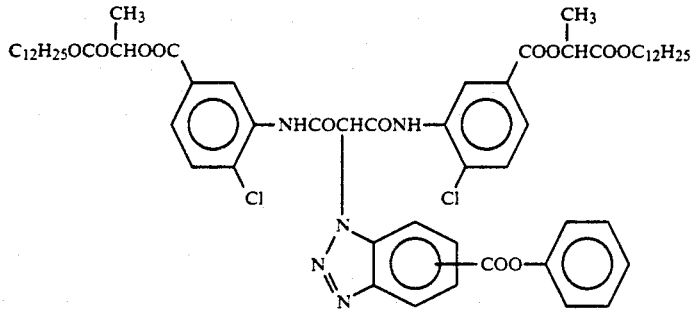
ExY-11
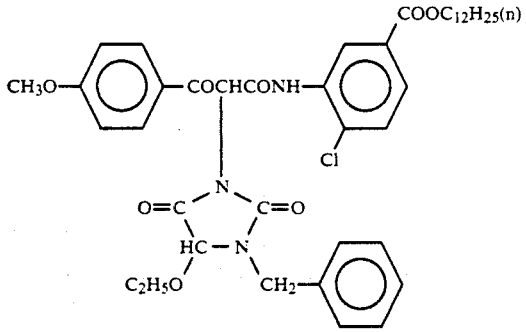
ExY-12
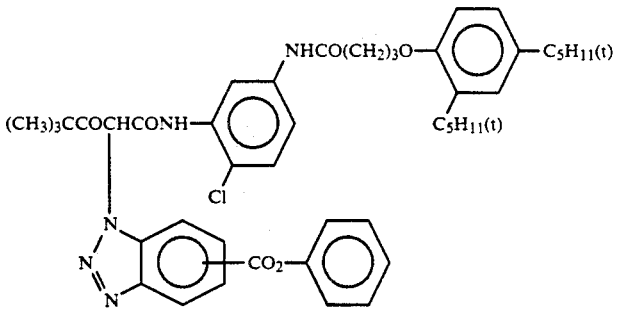
Cpd-7
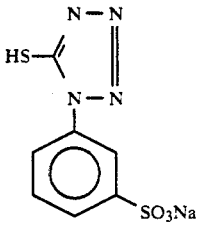

-continued

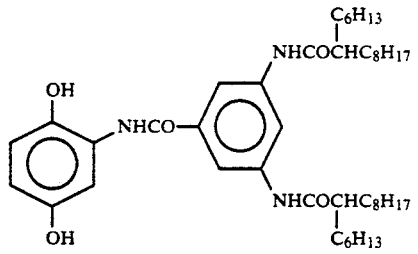

Cpd-1

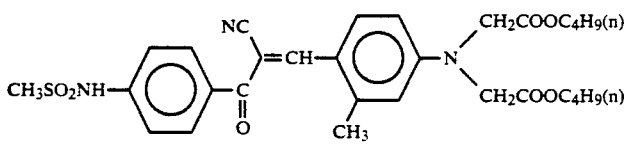

Cpd-2

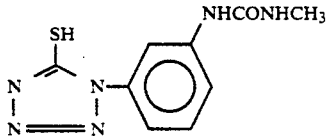

Cpd-6

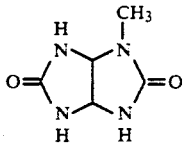

Cpd-5

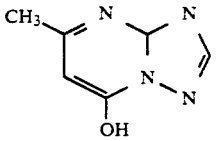

Cpd-3

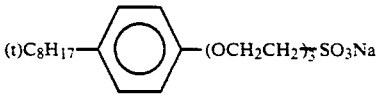

Cpd-4

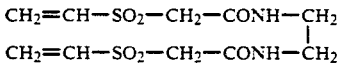

H-1

COMPARATIVE EXAMPLE 1

Sample 102 was prepared in the same way as Sample 101 except that compound ExC-1 was changed for compound A and ExC-4 was changed for compound B, these respectively being used in the same molar amounts.

Compound A

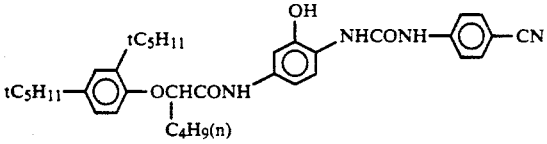

Compound B

-continued

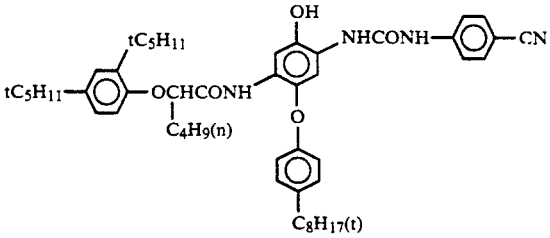

COMPARATIVE EXAMPLE 2

Sample 103 was prepared in the same way using compounds C and D instead of ExC-1 and ExC-4.

Compound C

-continued

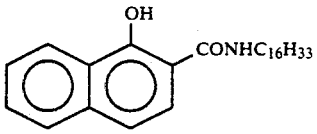

Compound D

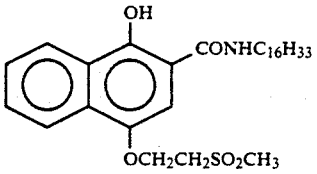

The color photographic materials prepared in this way were processed in an automatic developing machine using the following processing steps and processing solutions.

TABLE 1

| Processing Step | | | | |
|---|---|---|---|---|
| Process | Processing Temperature (°C.) | Time | Replenishment Amount* | Tank Cap. (l) |
| Color development | 37.8° C. | 3' 15" | 21 ml | 5 |
| Bleaching | 38.0° C. | 45" | 45 ml | 2 |
| Fixing (1) | 38.0° C. | 45" | 2-tank counter-current system | 2 |
| Fixing (2) | 38.0° C. | 45" | 30 ml | 2 |
| Stabilization (1) | 38.0° C. | 20" | 3-tank counter-current system | 1 |
| Stabilization (2) | 38.0° C. | 20" | | 1 |
| Stabilization (3) | 38.0° C. | 20" | 35 ml | 1 |
| Drying | 55.0° C. | 1' 00" | | |

Cap. = Capacity
*Replenishment amount: per 1 m of photo-sensitive material 35 mm wide The automatic developing machine used for processing the samples was equipped with a jet stream-stirring means as described in JP-A-62-183460 (page 3), and the process was effected using a jet stream of the fixing solution directed to the emulsion surface of the sample.

| | Main Solution (g) | Replenishment Solution (g) |
|---|---|---|
| Color Developing Solution: | | |
| Diethylenetriaminepentaacetic acid | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-(N-Ethyl-N-β-hydroxyethylamino)-2-methylaniline sulfate | 4.7 | 6.2 |
| Water to make | 1.0 l | 1.0 l |
| pH | 10.00 | 10.15 |

| | Main Solution (g) | Replenishment Solution (g) |
|---|---|---|
| Bleaching Solution: | | |
| (1,3-Diaminopropanetetraacetato)iron(III) complex salt | 130 (0.36 mol/) | 190 (0.53 mol/) |
| 1,3-Diaminopropanetetraacetic acid | 3.0 | 4.0 |
| Ammonium bromide | 85 | 120 |
| Acetic acid | 50 | 70 |
| Ammonium nitrate | 30 | 40 |
| Water to make | 1.0 l | 1.0 l |
| pH adjusted with acetic acid and ammonia | 4.3 | 3.5 |

| | Main Solution (g) | Replenishment Solution (g) |
|---|---|---|
| Fixing Solution: | | |
| 1-Hydroxyethylidene-1,1-diphosphonic acid | 5.0 | 7.0 |
| Ethylenediaminetetraacetic acid disodium salt | 0.5 | 0.7 |
| Sodium sulfite | 10.0 | 12.0 |
| Sodium bisulfite | 8.0 | 10.0 |
| Aqueous ammonium thiosulfate solution (700 g/liter) | 170.0 ml | 200.0 ml |
| Ammonium thiocyanate | 100.0 | 150.0 |
| Thiourea | 3.0 | 5.0 |
| 3,6-Dithia-1,8-octanediol | 3.0 | 5.0 |
| Water to make | 1.0 l | 1.0 l |
| pH adjusted by adding acetic acid and ammonia | 6.5 | 6.7 |

| Stabilizing Solution: both main solution and replenishment solution | |
|---|---|
| Formalin (37%) | 1.2 ml |
| 5-Chloro-2-methyl-4-isothiazolin-3-one | 6.0 mg |
| 2-Methyl-4-isothiazolin-3-one | 3.0 mg |
| Surfactant ($C_{10}H_{21}$—O—$(CH_2CH_2O)_{10}H$) | 0.4 |
| Ethylene glycol | 1.0 |
| Water to make | 1.0 l |
| pH | 5.0 to 7.0 |

The above photosensitive materials 101 to 103 were cut into 35 mm widths and subjected to standard exposures within a camera. 2,000 m of each of these were processed to produce exhausted solutions. The samples 101 to 103, which had been subjected to an image exposure, were passed through these exhausted solutions and through freshly produced processing solutions (referred to as fresh solutions). The cyan image densities obtained as a result were measured and the cyan density obtained by processing in an exhausted solution at an exposure which would produce a cyan density of 1.5 when processed in a fresh solution was determined.

TABLE 2

| Cyan densities when processing in exhausted solutions | |
|---|---|
| Sample No. | Cyan Density |
| 101 (this invention) | 1.49 |
| 102 (comparison) | 1.47 |
| 103 (comparison) | 1.38 |

It will be seen from the above results that, with the couplers of this invention, there is little reduction in cyan density in exhausted developing solutions.

EXAMPLE 2

The added amounts for the (1,3-diaminopropanetetraacetato)iron(III) complex salt and the 1,3-diaminopropanetetraacetic acid in the breaching solution of Example 1 were reduced by 50% in both the main solution and the replenishment solution. Processing was carried out in exactly the same way as in Example 1 except that Sample 101 was employed using this bleaching solution. As a result, it was found that there was a susceptibility to exhaustion with the exhausted solution only giving a cyan density of 1.47 at the same exposure as that which would give a cyan density of 1.5 in a fresh solution.

EXAMPLE 3

The pH of the bleaching solution in Example 1 was adjusted by adding ammonia water and acetic acid. An exhausted running solution was prepared in the same way as in Example 1 using the sample 101. Processing solutions with a pH of 6.0, 5.5, 4.8, 4.3, 3.5 and 2.0 were prepared by adjusting the pH of the solution by the abovementioned method, exhausted solutions and fresh solutions alike. Upon investigating the cyan density obtained in exhausted solutions at an exposure which would give a cyan density of 1.5 in a fresh solution, it was found that densities of 1.49 to 1.50 were obtained at pH 6.0 to 3.5 and of 1.46 at pH 2.0 and that there was no density reduction in exhausted solutions beyond pH 2.0.

EXAMPLE 4

The samples processed in fresh solutions in Example 3 were stored for 1 week at 60° C. and 70% humidity and the variations in the 1.5 cyan density immediately after processing were investigated. The results are shown in the following table.

| Bleach solution pH | 6.0 | 5.5 | 4.8 | 4.3 | 3.5 | 2.0 |
|---|---|---|---|---|---|---|
| Cyan density | 1.64 | 1.56 | 1.55 | 1.54 | 1.53 | 1.53 |

It can be seen from the above, that there is little variation in densities after processing at pH 5.5 or below.

EXAMPLE 5

Results almost the same as those in Example 1 were obtained using compounds A-2, A-3, A-9 and A-11 of this invention instead of ExC-1 and A-19, A-20, A-25, A-27, A-29, A-31 and A-77 instead of ExC-4 in the photosensitive material 101, and the effects of the 5-amido cyan couplers of this invention were confirmed.

EXAMPLE 6

The same processing as in Example 1 was carried out using Samples 101 to 103 of Example 1 and varying the processing steps and processing solutions as shown below. As a result, results almost similar to those of Example 1 were obtained and the effects of the combination of photosensitive materials having couplers of this invention and processing solutions of this invention were confirmed.

TABLE 3

| Processing Steps | | | | |
|---|---|---|---|---|
| Process | Processing Temperature (°C.) | Time | Replenishment Amount* | Tank Capacity (l) |
| Color development | 40.0 | 2' 15" | 15 ml | 4 |
| Bleaching | 38.0 | 45" | 45 ml | 2 |
| Fixing (1) | 38.0 | 45" | 2-tank counter-current system 15 ml | 2 |
| Fixing (2) | 38.0 | 45" | | 2 |
| Washing (1) | 38.0 | 15" | 2-tank counter-current system 15 ml | 1 |
| Washing (2) | 38.0 | 15" | | 1 |
| Stabilization | 38.0 | 15" | 15 ml | 1 |

TABLE 3-continued

| Processing Steps | | | | |
|---|---|---|---|---|
| Process | Processing Temperature (°C.) | Time | Replenishment Amount* | Tank Capacity (l) |
| Drying | 60.0 | 45" | | |

*Replenishment amount: per 1 m of photo-sensitive material 35 mm wide

The automatic developing apparatus used was one equipped with a bleaching solution jet stirring device in the same way as Example 1.

| | Main Solution (g) | Replenishment Solution (g) |
|---|---|---|
| Color Developing Solution: | | |
| Diethylenetriaminepentaacetic acid | 5.0 | 7.0 |
| Sodium sulfite | 4.0 | 6.0 |
| Potassium carbonate | 30.0 | 35.0 |
| Potassium bromide | 1.3 | 0.2 |
| Potassium iodide | 1.2 mg | — |
| Hydroxylamine sulfate | 2.0 | 4.0 |
| 4-(N-Ethyl-N-β-hydroxyethylamino)-2-methylaniline sulfate | 4.7 | 6.5 |
| 1-Hydroxyethylidene-1,1-diphosphonic acid | 3.0 | 4.0 |
| Water to make | 1.0 l | 1.0 l |
| pH | 10.05 | 10.20 |

| | Main Solution (g) | Replenishment Solution (g) |
|---|---|---|
| Bleaching Solution: | | |
| (1,3-Diaminopropanetetraacetato)iron(III) complex salt | 120 (0.33 mol/l) | 180 (0.50 mol/l) |
| 1,3-Diaminopropanetetraacetic acid | 3.0 | 5.0 |
| Ammonium bromide | 100 | 150 |
| Acetic acid | 50 | 80 |
| Ammonium nitrate | 30 | 40 |
| Water to make | 1.0 l | 1.0 l |
| pH (adjusted with acetic acid and ammonia) | 4.0 | 3.3 |

| | Main Solution (g) | Replenishment-Solution (g) |
|---|---|---|
| Fixing Solution: | | |
| 1-Hydroxyethylidene-1,1-diphosphonic acid | 7.0 | 10.0 |
| Ethylenediaminetetraacetic acid, disodium salt | 7.0 | 10.0 |
| Ammonium sulfite | 16.0 (g) | |
| Ammonium thiosulfate solution (700 g/l) | 240 ml | 280 ml |
| 3,6-Dithia-1,8-octanediol | 5.0 | 7.0 |
| Water to make | 1.0 l | 1.0 l |
| pH adjusted by adding acetic acid and ammonia | 6.5 | 6.5 |
| Washing Water: | | |
| both main solution and replenishment solution | | |

Tap water was passed through a mixed bed column packed with an H-type strongly acidic cation exchange resin (Amberlite 1R-120 B made by the Rohm and Haas Company) and an OH-type anion exchange resin (Amberlite IR-400 made by the same company) and treated to calcium and magnesium ion concentrations of not more than 3 mg/l, and than 20 mg/l of sodium isocyanurate dichloride and 0.15 g/l of sodium sulfate were added.

The pH of this solution was in the range of 6.5 to 7.5.

| Stabilizing Solution: | Main Solution (g) | Replenishment Solution (g) |
|---|---|---|
| Formalin (37%) | 2.0 ml | 3.0 ml |
| Polyoxyethylene p-monononyl-phenyl ether (average degree of polymerization 10) | 0.3 | 0.45 |
| Ethylenediaminetetraacetic acid, disodium salt | 0.05 | 0.08 |
| Water to make | 1.0 l | 1.0 l |
| pH | 5.0–8.0 | 5.0–8.0 |

EXAMPLE 7

Plural layers each having the composition described below were provided on a cellulose triacetate film support coated with a subbing layer to prepare a multilayer color photographic material (Sample No. 701).

The compositions of the layers are described below. The amount coated is represented by units of g(silver)/$m^2$ for colloidal silver and silver halide, by units of g/$m^2$ for couplers, additives and gelatin, and by units of mols per mol of silver halide present in the same layer for the sensitizing dyes.

| | |
|---|---|
| First Layer: Anti-halation Layer | |
| Black colloidal silver | 0.18 as Ag |
| Gelatin | 0.40 |
| Second Layer: Interlayer | |
| 2,5-Di-t-pentadecylhydroquinone | 0.18 |
| EX-1" | 0.07 |
| Ex-3" | 0.02 |
| EX-12" | 0.002 |
| U-1" | 0.06 |
| U-2" | 0.08 |
| U-3" | 0.10 |
| HBS-1" | 0.10 |
| HBS-2" | 0.02 |
| Gelatin | 1.04 |
| Third Layer: First Red-sensitive Emulsion Layer | |
| Emulsion A | 0.25 as Ag |
| Emulsion B | 0.25 as Ag |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2" | 0.335 |
| EX-10" | 0.020 |
| Gelatin | 0.87 |
| Fourth Layer: Second Red-sensitive Emulsion Layer | |
| Emulsion C | 1.0 as Ag |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2" | 0.400 |
| EX-3" | 0.050 |
| EX-10" | 0.015 |
| Gelatin | 1.30 |
| Fifth Layer: Third Red-sensitive Emulsion Layer | |
| Emulsion D | 1.60 as Ag |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-3" | 0.010 |
| EX-4" | 0.080 |
| EX-2" | 0.097 |
| HBS-1" | 0.22 |
| HBS-2" | 0.10 |
| Gelatin | 1.63 |
| Sixth Layer: Interlayer | |
| EX-5" | 0.040 |
| HBS-1" | 0.020 |
| Gelatin | 0.80 |

-continued

| | |
|---|---|
| Seventh Layer: First Green-sensitive Emulsion Layer | |
| Emulsion A | 0.15 as Ag |
| Emulsion B | 0.15 as Ag |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6" | 0.260 |
| EX-1" | 0.021 |
| EX-7" | 0.030 |
| EX-8" | 0.025 |
| HBS-1" | 0.100 |
| HBS-3" | 0.010 |
| Gelatin | 0.63 |
| Eighth Layer: Second Green-sensitive Emulsion Layer | |
| Emulsion C | 0.45 as Ag |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6" | 0.094 |
| EX-8" | 0.018 |
| EX-7" | 0.026 |
| HBS-1" | 0.160 |
| HBS-3" | 0.008 |
| Gelatin | 0.50 |
| Ninth Layer: Third Green-sensitive Emulsion Layer | |
| Emulsion E | 1.2 as Ag |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13" | 0.015 |
| EX-11" | 0.100 |
| EX-1" | 0.025 |
| HBS-1" | 0.25 |
| HBS-2" | 0.10 |
| Gelatin | 1.54 |
| Tenth Layer: Yellow Filter Layer | |
| Yellow Colloidal Silver | 0.05 as Ag |
| EX-5" | 0.08 |
| HBS-1" | 0.03 |
| Gelatin | 0.95 |
| Eleventh Layer: First Blue-sensitive Emulsion Layer | |
| Emulsion A | 0.08 as Ag |
| Emulsion B | 0.07 as Ag |
| Emulsion F | 0.07 as Ag |
| Sensitizing Dye VIII | $3.5 \times 10^{-4}$ |
| EX-9" | 0.721 |
| EX-8" | 0.042 |
| HBS-1" | 0.28 |
| Gelatin | 1.10 |
| Twelfth Layer: Second Blue-sensitive Emulsion Layer | |
| Emulsion G | 0.45 as Ag |
| Sensitizing Dye VIII | $2.1 \times 10^{-4}$ |
| EX-9" | 0.154 |
| EX-10" | 0.007 |
| HBS-1" | 0.05 |
| Gelatin | 0.78 |
| Thirteenth Layer: Third Blue-sensitive Emulsion Layer | |
| Emulsion H | 0.77 as Ag |
| Sensitizing Dye VIII | $2.2 \times 10^{-4}$ |
| EX-9" | 0.20 |
| HBS-1" | 0.07 |
| Gelatin | 0.69 |
| Fourteenth Layer: First Protective Layer | |
| Emulsion I | 0.5 as Ag |
| U-4" | 0.11 |
| U-5" | 0.17 |
| HBS-1" | 0.05 |
| Gelatin | 1.00 |
| Fifteenth Layer: Second Protective Layer | |
| Polymethyl Acrylate Grains (diameter 1.5 μm) | 0.54 |
| S-1" | 0.20 |
| Gelatin | 1.20 |

Gelatin hardening agent (H-1) and surfactant were added to each layer, in addition to the above-described components.

TABLE 4

| Emulsion | Mean AgI-Content (%) | Mean Grain Size (μm) | Fluctuation Coefficient of Grain Size (%) | Ratio of Diameter/Thickness | Silver Content (AgI Content mol %) |
|---|---|---|---|---|---|
| A | 4.3 | 0.45 | 27 | 1 | core/interlayer/shell = 8/16/76 (0/27/0); 3-layered grains |
| B | 8.7 | 0.70 | 14 | 1 | core/interlayer/shell = 8/16/76 (0/27/0); 3-layered grains |
| C | 10 | 0.75 | 30 | 2 | core/shell = ½ (24/3); 2-layered grains |
| D | 16 | 1.05 | 35 | 2 | core/shell = ½ (40/0); 2-layered grains |
| E | 10 | 1.05 | 35 | 3 | core/shell = ½ (24/3); 2-layered grains |
| F | 4.3 | 0.25 | 28 | 1 | core/interlayer/shell = 8/16/76 (0/27/0); 3-layered grains |
| G | 14 | 0.75 | 25 | 2 | core/shell = ½ (40/0); 2-layered grains |
| H | 14 | 1.30 | 25 | 3 | core/shell = ½ (24/3); 2-layered grains |
| I | 1 | 0.07 | 15 | 1 | |

Compounds used for preparing the samples are as follows:

EX-1"

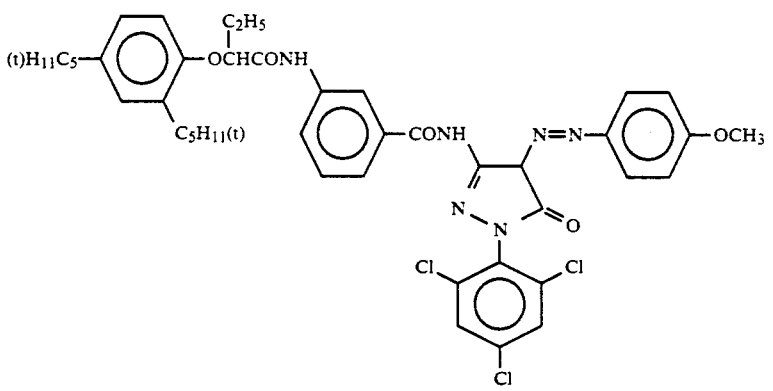

EX-2"

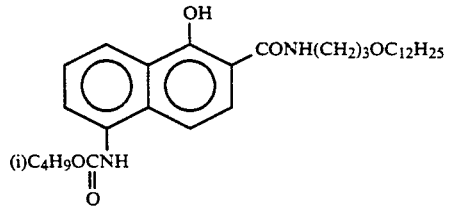

EX-3"

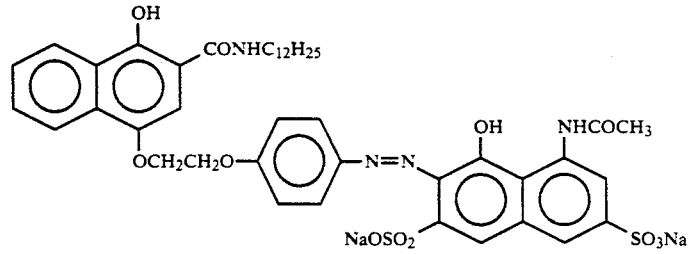

-continued
EX-4''
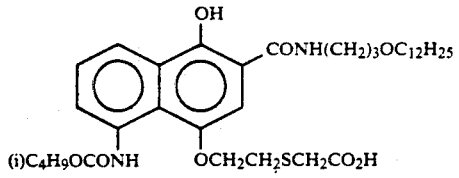
EX-5''
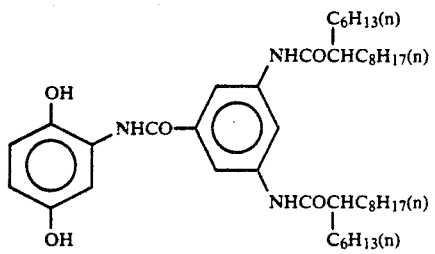
EX-6''
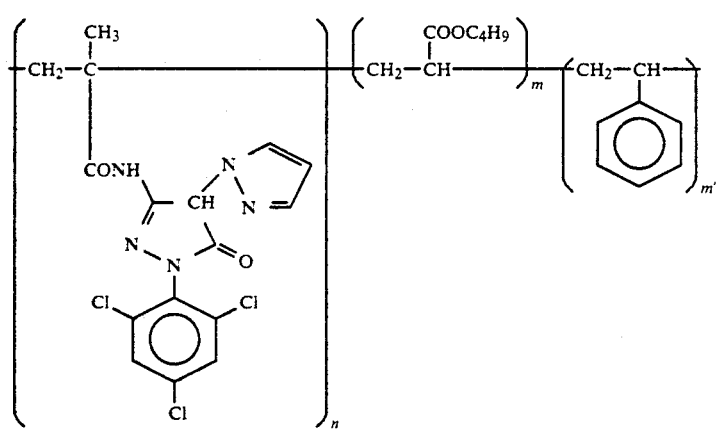
n = 50
m = 25
m' = 25 (by mol)
mol. wt. ca. 20,000
EX-7''
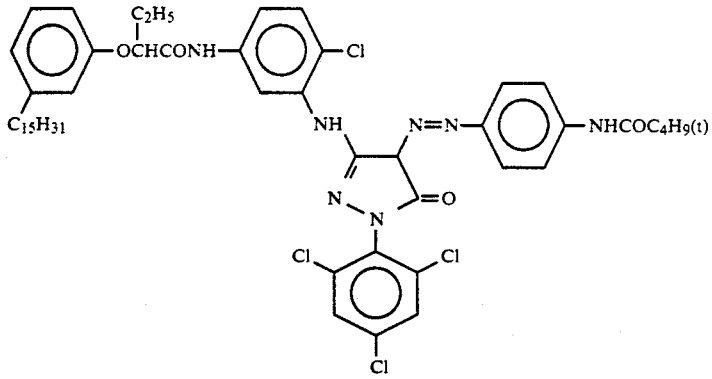
EX-8''
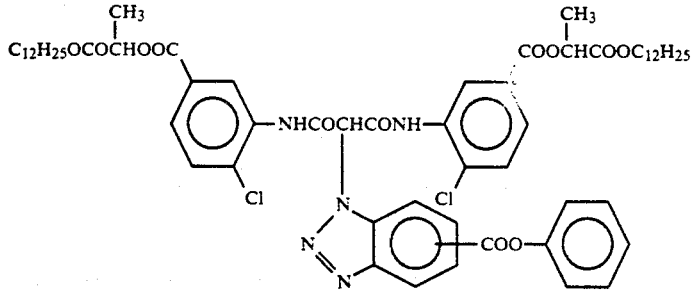

-continued
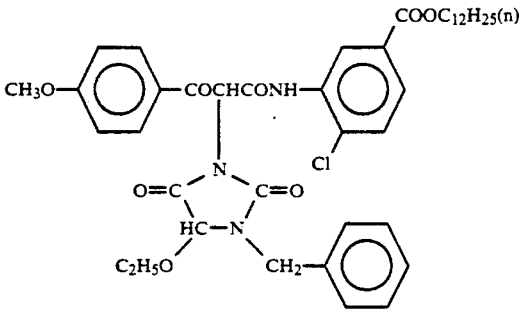
EX-9''
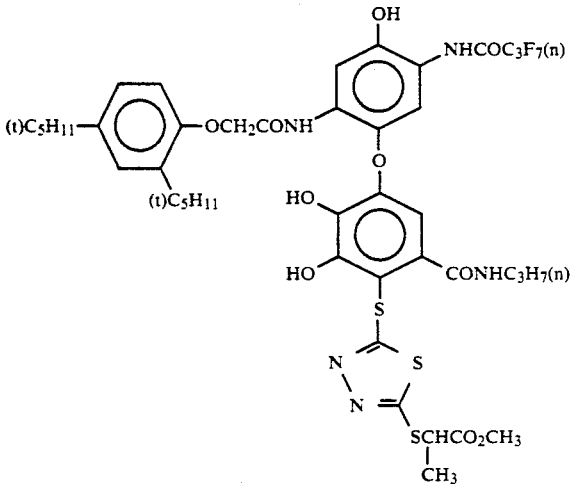
EX-10''
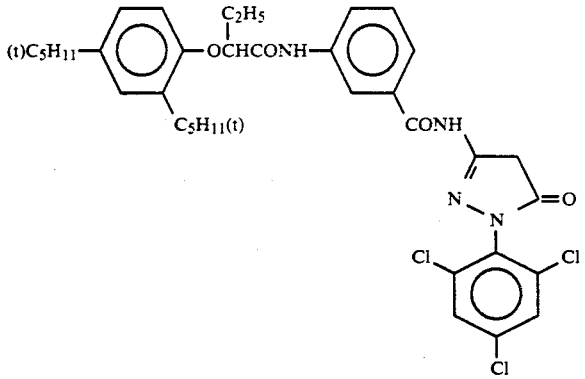
EX-11''
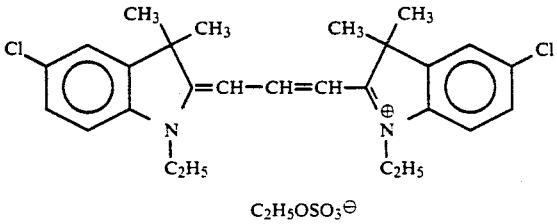
EX-12''

-continued
EX-13″
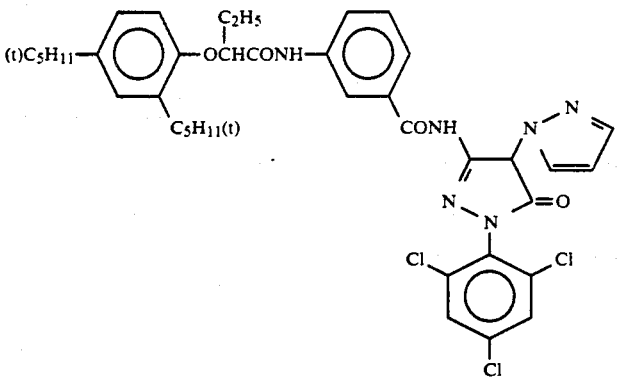
U-1″
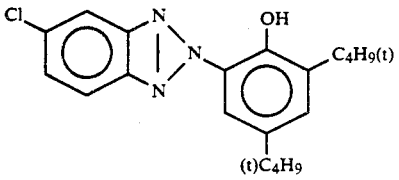
U-2″
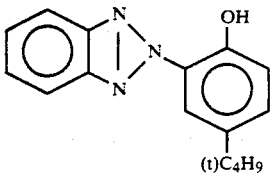
U-3″
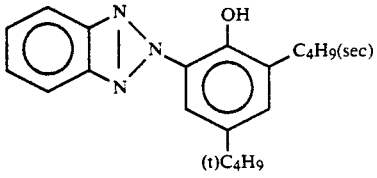
U-4″
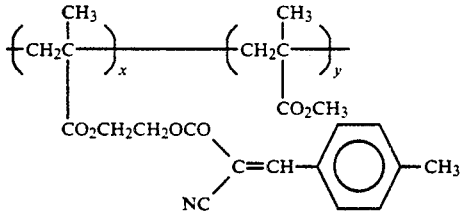
x:y = 70:30 (wt %)
UV-5″
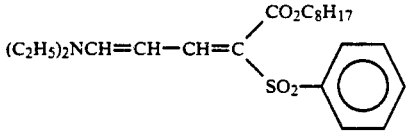
Tricresyl Phosphate HBS-1″
Di-n-butyl Phthalate HBS-2″
HBS-3″
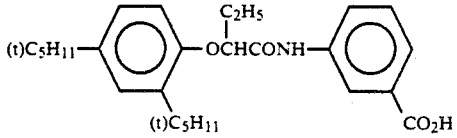

-continued

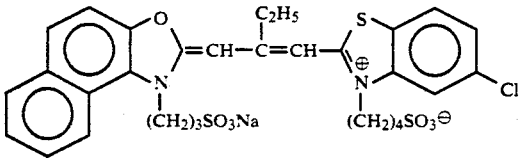

Sensitizing Dye I

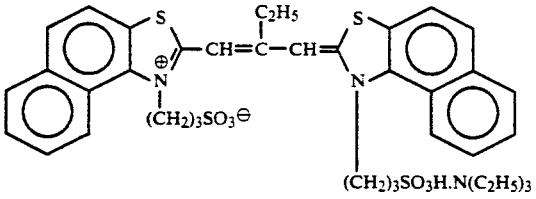

Sensitizing Dye II

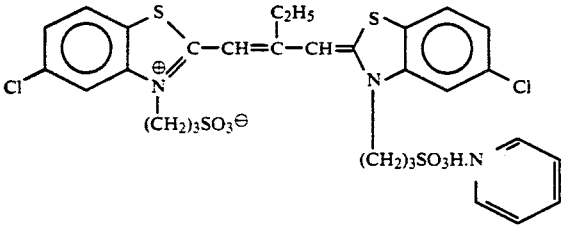

Sensitizing Dye III

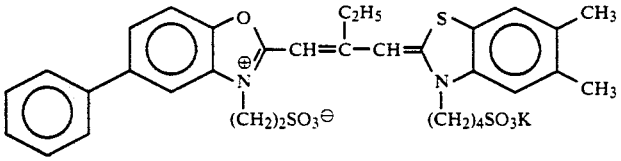

Sensitizing Dye V

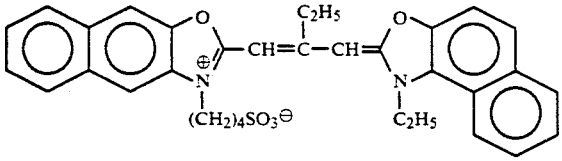

Sensitizing Dye VI

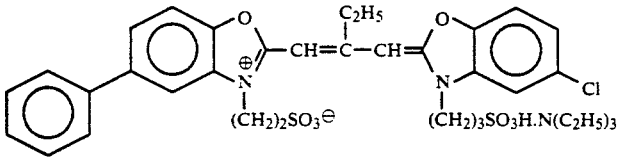

Sensitizing Dye VII

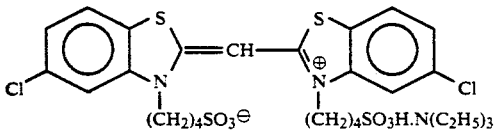

Sensitizing Dye VIII

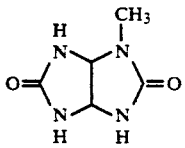

S-1"

$CH_2{=}CH{-}SO_2{-}CH_2{-}CONH{-}CH_2$
$CH_2{=}CH{-}SO_2{-}CH_2{-}CONH{-}CH_2$

H-1"

Samples 702 and 703 were prepared in the same way as in Example 1 using EX-2 and EX-4 of sample 701 and compounds A–D of Example 1. Upon carrying out processing in the same way as in Example 1 using these samples 701–703, almost the same results are those of Example 1 were obtained.

EXAMPLE 8

Plural layers each having the composition mentioned below were provided on a cellulose triacetate film support coated with a subbing layer to prepare a multilayer color photographic material (Sample No. 801).

The compositions of the layers are described below.

The amount coated is represented by units of g(silver)/$m^2$ for colloidal silver and silver halide, by units of g/$m^2$ for couplers, additives and gelatin, and by units of mol per mol of silver halide present in the same layer for the sensitizing dyes.

| | |
|---|---|
| First Layer: Anti-halation Layer | |
| Black Colloidal Silver | 0.2 |
| Gelatin | 1.3 |
| ExM-8' | 0.06 |
| UV-1' | 0.1 |
| UV-2' | 0.2 |
| Solv-1' | 0.01 |
| Solv-1' | 0.01 |
| Second Layer: Interlayer | |
| Fine Silver Bromide Grains (Mean grain size 0.07 μm) | 0.10 |
| Gelatin | 1.5 |
| UV-1' | 0.06 |
| UV-2' | 0.03 |
| ExC-2' | 0.02 |
| ExF-1' | 0.004 |
| Solv-1' | 0.1 |
| Solv-2' | 0.09 |
| Third Layer: First Red-sensitive Emulsion Layer | |
| Silver Iodobromide Emulsion (AgI 2 mol %; AgI-rich core type; sphere-corresponding diameter 0.3 μm; fluctuation coefficient of sphere-corresponding diameter 29%; normal crystal/twin crystal composite grains; ratio of diameter/thickness 2.5) | 0.4 as Ag |
| Gelatin | 0.6 |
| ExS-1' | $1.0 \times 10^{-4}$ |
| ExS-2' | $3.0 \times 10^{-4}$ |
| ExS-3' | $1 \times 10^{-5}$ |
| ExC-3' | 0.06 |
| ExC-4' | 0.06 |
| ExC-7' | 0.04 |
| ExC-2' | 0.03 |
| Solv-1' | 0.03 |
| Solv-3' | 0.012 |
| Fourth Layer: Second Red-sensitive Emulsion Layer | |
| Silver Iodobromide Emulsion (AgI 5 mol %; AgI-rich core type; sphere-corresponding diameter 0.7 μm; fluctuation coefficient of sphere-corresponding diameter 25%; normal crystal/twin crystal composite grains; ratio of diameter/thickness 4) | 0.7 as Ag |
| Gelatin | 0.5 |
| ExS-1' | $1 \times 10^{-4}$ |
| ExS-2' | $3 \times 10^{-4}$ |
| ExS-3' | $1 \times 10^{-5}$ |
| ExC-3' | 0.24 |
| ExC-4' | 0.24 |
| ExC-7' | 0.04 |
| ExC-2' | 0.04 |
| Solv-1' | 0.15 |
| Solv-3' | 0.02 |
| Fifth Layer: Third Red-sensitive Emulsion Layer | |
| Silver Iodobromide Emulsion (AgI 10 mol %; AgI-rich core type; sphere-corresponding diameter 0.8 μm; fluctuation coefficient of sphere-corresponding diameter 16%; normal crystal/twin crystal composite grains; ratio of diameter/thickness 1.3) | 1.0 as Ag |
| Gelatin | 1.0 |
| ExS-1' | $1 \times 10^{-4}$ |
| ExS-2' | $3 \times 10^{-4}$ |
| ExS-3' | $1 \times 10^{-5}$ |
| ExC-5' | 0.05 |
| ExC-6' | 0.1 |
| Solv-1' | 0.01 |
| Solv-2' | 0.05 |
| Sixth Layer: Interlayer | |
| Gelatin | 1.0 |
| Cpd-1' | 0.03 |
| Solv-1' | 0.05 |
| Seventh Layer: First Green-sensitive Emulsion Layer | |
| Silver Iodobromide Emulsion (AgI 2 mol %; AgI-rich core type; sphere-corresponding diameter 0.3 μm; fluctuation coefficient of sphere-corresponding diameter 28%; normal crystal/twin crystal composite grains; ratio of diameter/thickness 2.5) | 0.30 as Ag |
| ExS-4' | $5 \times 10^{-4}$ |
| ExS-6' | $0.3 \times 10^{-4}$ |
| ExS-5' | $2 \times 10^{-4}$ |
| Gelatin | 1.0 |
| ExM-9' | 0.2 |
| ExY-14' | 0.03 |
| ExM-8' | 0.03 |
| Solv-1' | 0.5 |
| Eighth Layer: Second Green-sensitive Emulsion Layer | |
| Silver Iodobromide Emulsion (AgI 4 mol %; AgI-rich core type; sphere-corresponding diameter 0.6 μm; fluctuation coefficient of sphere-corresponding diameter 38%; normal crystal/twin crystal composite grains; ratio of diameter/thickness 4) | 0.4 as Ag |
| Gelatin | 0.5 |
| ExS-4' | $5 \times 10^{-4}$ |
| ExS-5' | $2 \times 10^{-4}$ |
| ExS-6' | $0.3 \times 10^{-4}$ |
| ExM-9' | 0.25 |
| ExM-8' | 0.03 |
| ExM-10' | 0.015 |
| ExY-14' | 0.01 |
| Solv-1' | 0.2 |
| Ninth Layer: Third Green-sensitive Emulsion Layer | |
| Silver Iodobromide Emulsion (AgI 6 mol %; AgI-rich core type; sphere-corresponding diameter 1.0 μm; fluctuation coefficient of sphere-corresponding diameter 80%; normal crystal/twin crystal composite grains; ratio of diameter/thickness 1.2) | 0.85 as Ag |
| Gelatin | 1.0 |
| ExS-7' | $3.5 \times 10^{-4}$ |
| ExS-8' | $1.4 \times 10^{-4}$ |
| ExM-11' | 0.01 |
| ExM-12' | 0.03 |
| ExM-13' | 0.20 |
| ExM-8' | 0.02 |
| ExY-15' | 0.02 |
| Solv-1' | 0.20 |
| Solv-2' | 0.05 |
| Tenth Layer: Yellow Filter Layer | |
| Gelatin | 1.2 |
| Yellow Colloidal Silver | 0.08 |
| Cpd-2' | 0.1 |
| Solv-1' | 0.3 |
| Eleventh Layer: First Blue-sensitive Emulsion Layer | |
| Silver Iodobromide Emulsion (AgI 4 mol %; AgI-rich core type; sphere-corresponding diameter 0.5 μm; fluctuation coefficient of sphere-corresponding diameter 15%; octahedral grains) | 0.4 as Ag |
| Gelatin | 1.0 |
| ExS-9' | $2 \times 10^{-4}$ |

-continued

| | |
|---|---|
| ExY-16' | 0.9 |
| ExY-14' | 0.07 |
| Solv-1' | 0.2 |
| Twelfth Layer: Second Blue-sensitive Emulsion Layer | |
| Silver Iodobromide Emulsion (AgI 10 mol %; AgI-rich core type; sphere-corresponding diameter 1.3 μm; fluctuation coefficient of sphere-corresponding diameter 25%; normal crystal/twin crystal composite grains; ratio of diameter/thickness 4.5) | 0.5 as Ag |
| Gelatin | 0.6 |
| ExS-9' | $1 \times 10^{-4}$ |
| ExY-16' | 0.25 |
| Solv-1' | 0.07 |
| Thirteenth Layer: First Protective Layer | |
| Gelatin | 0.8 |
| UV-1' | 0.1 |

-continued

| | |
|---|---|
| UV-2' | 0.2 |
| Solv-1' | 0.01 |
| Solv-2' | 0.01 |
| Fourteenth Layer: Second Protective Layer | |
| Fine Silver Bromide Grains (mean grain size 0.07 μm) | 0.5 |
| Gelatin | 0.45 |
| Polymethyl Methacrylate Grains (diameter 1.5 μm) | 0.2 |
| H-1' | 0.4 |
| Cpd-3' | 0.5 |
| Cpd-4' | 0.5 |

The same surfactant as Example 1 was added to each layer as a coating aid, in addition to the above-mentioned components. The sample thus prepared was called Sample No. 801.

Chemical Structural formulae or chemical names of the compounds listed above are given below.

UV-1':

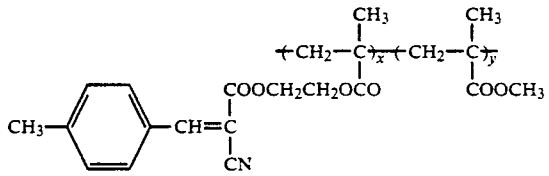

x/y = 7/3 (by weight)

UV-2':

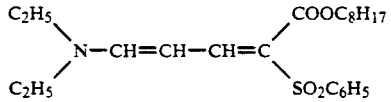

Solv-1': Tricresyl Phosphate
Solv-2': Dibutyl Phthalate
Solv-3': Bis(2-ethylhexyl) Phthalate ExM-8':

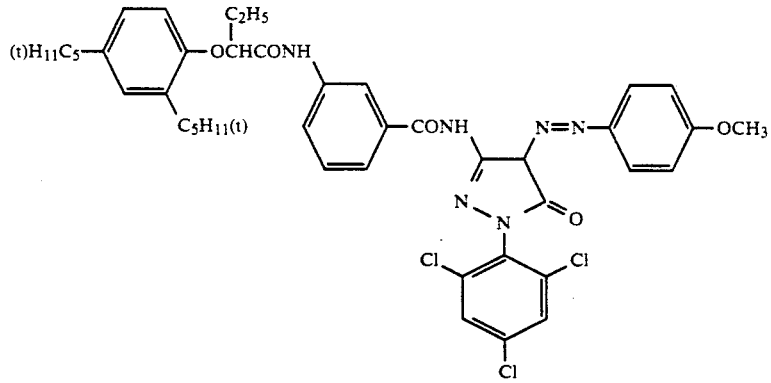

ExF-1':

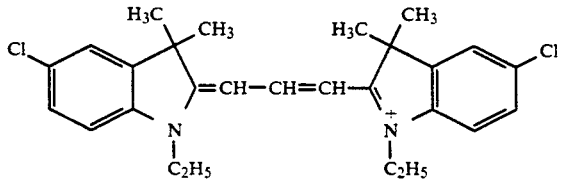

$C_2H_5OSO_3^-$

ExC-2':

-continued
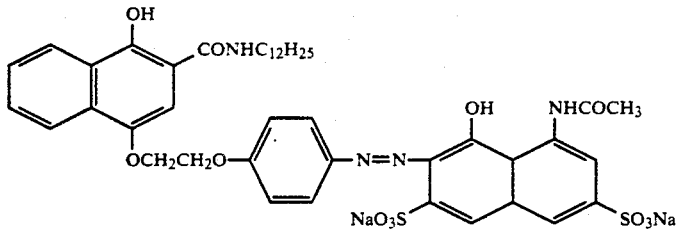
ExC-3':
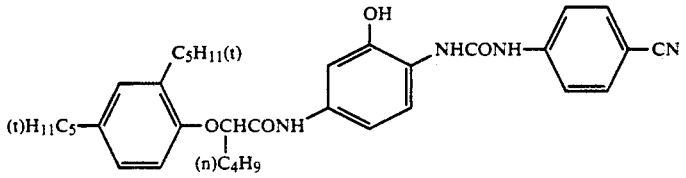
ExC-4':
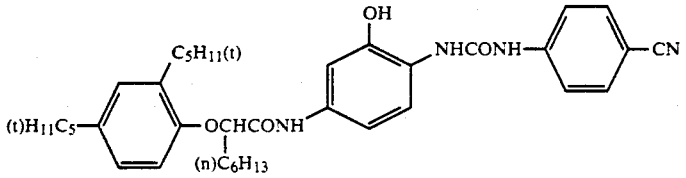
ExY-14':
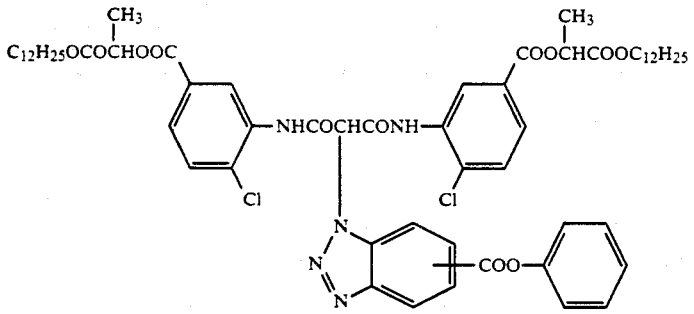
ExY-15':
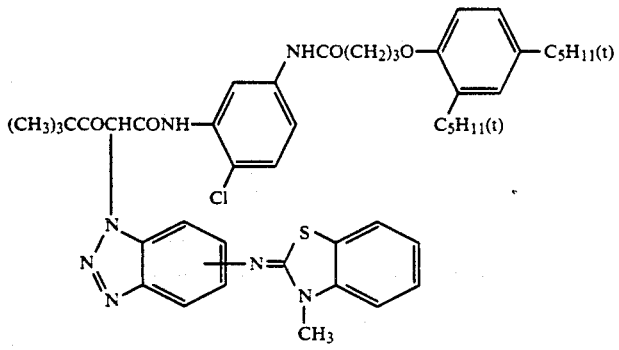
ExC-5':

-continued
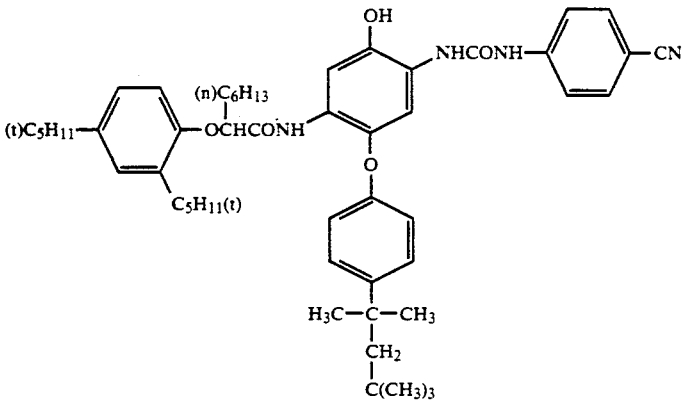
ExC-6':
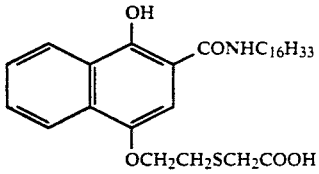
ExC-7':
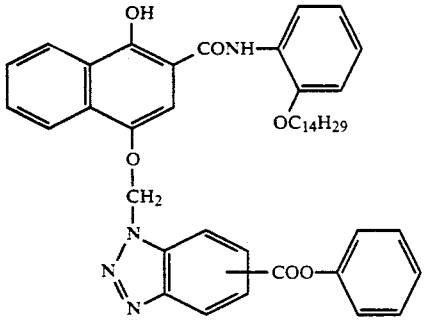
ExM-9':
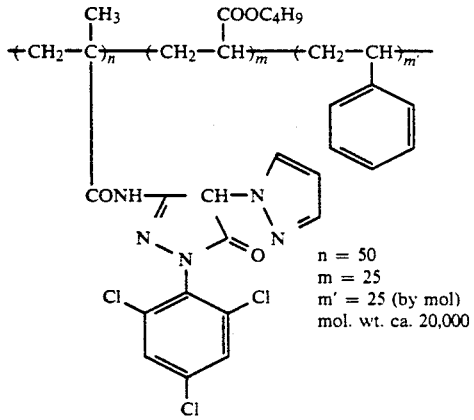
ExM-10':

-continued
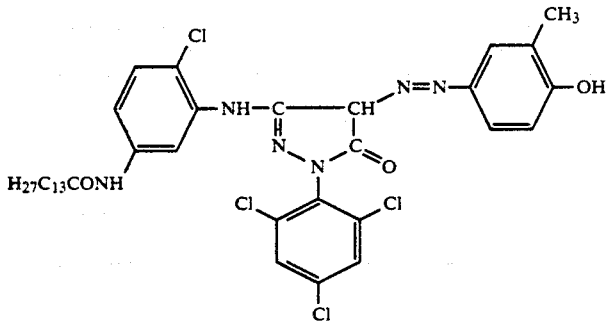
ExM-11':
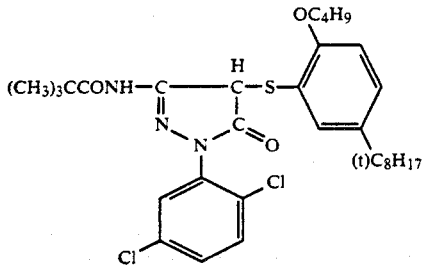
ExM-12':
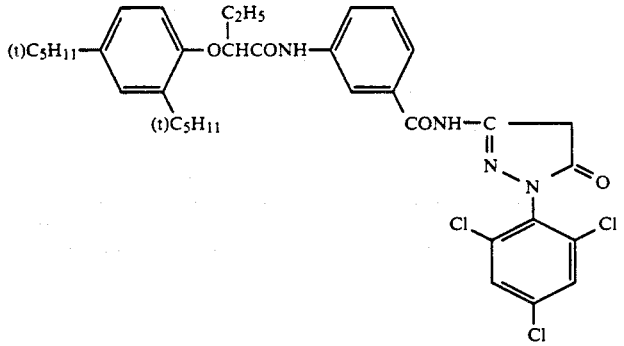
ExM-13':
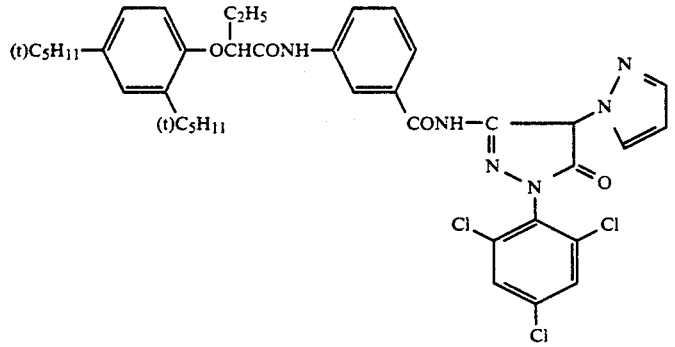
ExY-16':

-continued
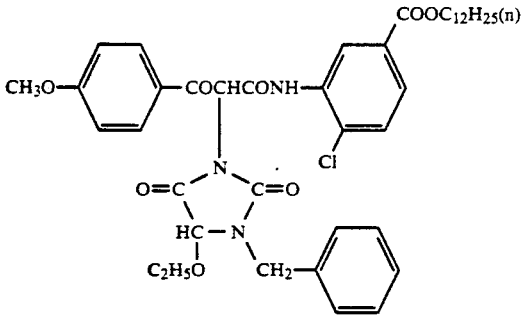
Cpd-1':
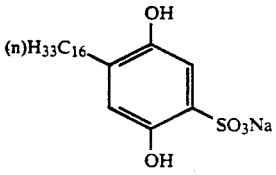
Cpd-2':
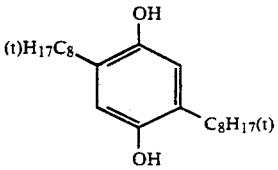
ExS-1':
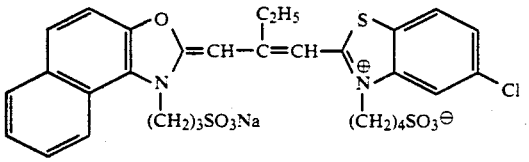
ExS-2':
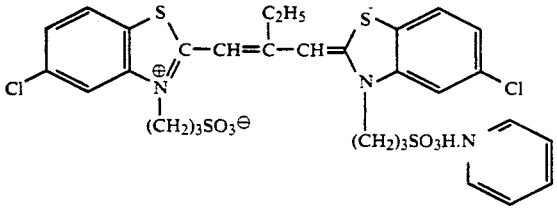
ExS-3':
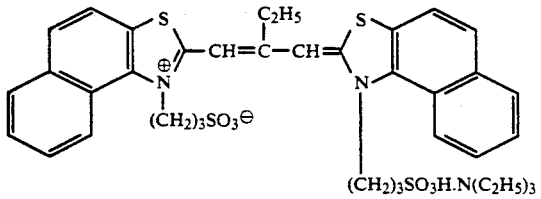
ExS-4':
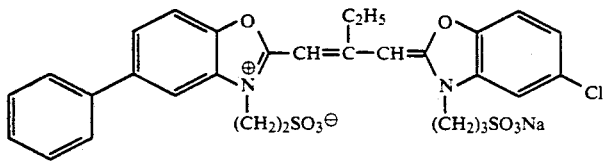
ExS-5':

-continued

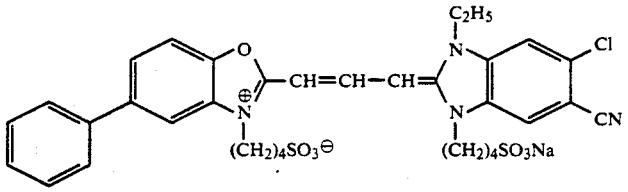

ExS-6':

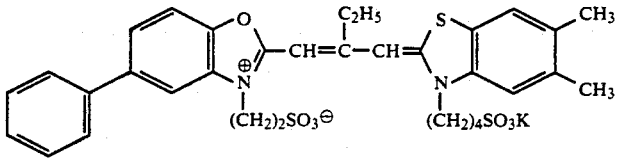

ExS-7':

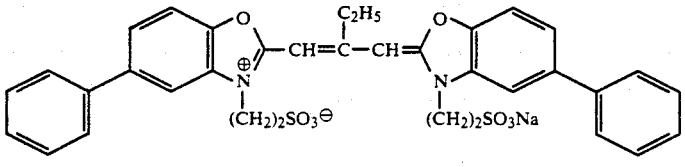

ExS-8':

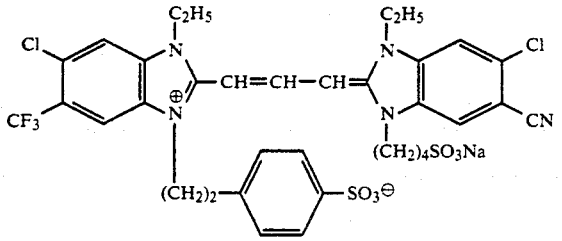

ExS-9':

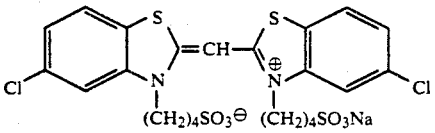

H-1':

$CH_2{=}CH{-}SO_2{-}CH_2{-}CONH{-}CH_2$ $CH_2{=}CH{-}SO_2{-}CH_2{-}CONH{-}CH_2$

Cpd-3':

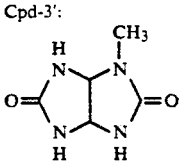

Cpd-4':

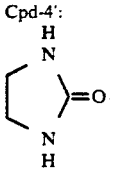

Sample 802 was prepared in the same way as 801 except that compounds of this invention were used instead of compounds ExC-3, ExC-4, and ExC-6 (all comparative compounds) of Sample 801, and A-18 was used instead of ExC-3 and ExC-4, and A-25 was used instead of ExC-6 in equivalent amounts. Upon carrying out the same processing as in Example 1 using Samples 801 and 802, almost the same results as Example 1 were obtained.

EXAMPLE 9

After carrying out an image exposure on Super HR-100, Super HR-400 and Super HR-1600, processing was carried out with the following processing steps using the following processing solutions. As a result, a clear image was obtained and the residual silver amount after processing was also small..

TABLE 5

| Stage | Processing Steps: Processing Temperature (°C.) | Time | Replenishment Amount* | Tank Capacity (l) |
|---|---|---|---|---|
| Color development | 37.8 | 3' 15" | 21 ml | 5 |
| Bleaching | 38.0 | 45" | 45 ml | 2 |
| Fixing (1) | 38.0 | 45" | 2-tank counter-current system 30 ml | 2 |
| Fixing (2) | 38.0 | 45" | | 2 |
| Stabilization (1) | 38.0 | 20" | 3-tank counter-current system | 1 |
| Stabilization (2) | 38.0 | 20" | | 1 |
| Stabilization (3) | 38.0 | 20" | 35 ml | 1 |
| Drying | 55.0 | 1' 00" | | |

*Replenishment amount: per 1 m length of photosensitive material 35 mm wide

The automatic developing machine used for processing the samples was equipped with a jet stream-stirring means as described in JP-A-62-183460 (page 3), and the process was effected using a jet stream of the fixing solution directed to the emulsion surface of the sample.

| | Main Solution (g) | Replenishment Solution (g) |
|---|---|---|
| Color Developing Solution: | | |
| Diethylenetriaminepentaacetic acid | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-(N-Ethyl-N-β-hydroxyethyl-amino)-2-methylaniline sulfate | 4.7 | 6.2 |
| Water to make | 1.0 l | 1.0 l |
| pH | 10.00 | 10.05 |

| | Main Solution (g) | Replenishment Solution (g) |
|---|---|---|
| Bleaching Solution: | | |
| (1,3-Diaminopropanetetra-acetato)iron(III) complex salt | 130 (0.36 mol/l) | 190 (0.53 mol/l) |
| 1,3-Diaminopropanetetraacetic acid | 3.0 | 4.0 |
| Ammonium bromide | 85 | 120 |
| Acetic acid | 50 | 70 |
| Ammonium nitrate | 30 | 40 |
| Water to make | 1.0 l | 1.0 l |
| pH (adjusted with acetic acid and ammonia) | 4.3 | 3.5 |

| | Main Solution (g) | Replenishment Solution (g) |
|---|---|---|
| Fixing Solution: | | |
| Ethylenediaminetetraacetic acid, disodium salt | 0.5 | 0.7 |
| Sodium sulfite | 10.0 | 12.0 |
| Sodium bisulfite | 8.0 | 10.0 |

-continued

| | | |
|---|---|---|
| Aqueous ammonium thiosulfate solution (700 g/l) | 170.0 ml | 200.0 ml |
| Ammonium thiocyanate | 100.0 | 150.0 |
| Thiourea | 1.5 | 2.0 |
| Water to make | 1.0 l | 1.0 l |
| pH adjusted by adding acetic acid and ammonia | 6.5 | 6.7 |

| Fixing Solution: both main solution and replenishment solution | |
|---|---|
| Formalin (37%) | 1.2 ml |
| 5-Chloro-2-methyl-4-isothiazolin-3-one | 6.0 mg |
| 2-Methyl-4-isothiazolin-3-one | 3.0 mg |
| Surfactant | 0.4 g |
| Ethylene glycol | 1.0 g |
| Water to make | 1.0 l |
| pH | 5.0–7.0 |

While the invention has been described in detail and with reference to specific embodiments thereof, it will be apparent to one skilled in the art that various changes and modifications can be made therein without departing from the spirit and scope thereof.

What is claimed is:

1. In a method for processing a silver halide color photographic material comprising a support having provided thereon at least one hydrophilic colloid layer wherein said material is imagewise exposed and then processed, the improvement comprising:

(a) providing in said at least one hydrophilic colloid layer at least one compound of the formula (A)

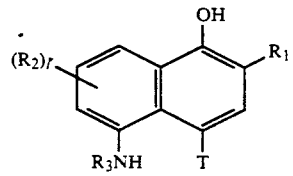

(A)

wherein, $R_1$ represents a halogen atom, an aliphatic group, an aromatic group, a heterocyclic group, an amidino group, a guanidino group or a group represented by $—COR_4$, $—SO_2R_4$, $—SOR_4$, $—NHCOR_4$, $—NHSO_2R_4$, $—NHSOR_4$, by $—COR_4$, $—SO_2R_4$, $—SOR_4$, $—NHCOR_4$, $—NHSO_2R_4$, $—NHSOR_4$,

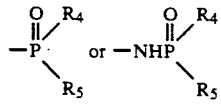

wherein $R_4$ and $R_5$, which may be the same or different, each represents an aliphatic group, an aromatic group, a heterocyclic group, an amino group, an aliphatic oxy group or an aromatic oxy group;

$R_2$ represents a halogen atom, a hydroxyl group, a carboxyl group, a sulfo group, an amino group, a cyano group, a nitro group, an aliphatic group, an aromatic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, an aliphatic sulfinyl group, an aromatic sulfinyl group, an aliphatic oxycarbonyl group, an aromatic oxycarbonyl group, an aliphatic oxycarbonylamino group, an aromatic oxycarbonylamino group, a sulfamoylamino group, a heterocyclic group or an imido group;

l' represents an integer of 0 to 3;

$R_3$ represents a hydrogen atom or $R_6U$ wherein $R_6$ represents a hydrogen atom, an aliphatic group, an aromatic group, a heterocyclic group, $—OR_7$, $—SR_7$, $—COR_8$, $—PO(R_7)_2$, $—PO(—OR_7)_2$, $—SO_2R_7$, $—SO_2OR_7$, $—CO_2R_7$,

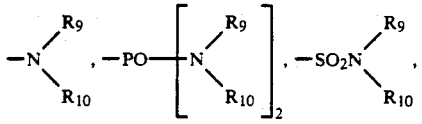

or an imido group, and U represents $>N—R_9$, —CO—, $—SO_2—$, —SO— or a single bond wherein $R_7$ represents an aliphatic group, an aromatic group or a heterocyclic group, $R_8$ represents a hydrogen atom, an aliphatic group, an aromatic group or a heterocyclic group, and $R_9$ and $R_{10}$, which may be the same or different, each represents a hydrogen atom, an aliphatic group, an aromatic group, a heterocyclic group, an acyl group, an aliphatic sulfonyl group or an aromatic sulfonyl group; and T represents a hydrogen atom or a group which is capable of elimination by means of a coupling reaction with the oxidized form of a primary aromatic amine developing agent, and when l' is 2 or 3, the $R_2$ groups may be the same or different and may bond together to form a ring, $R_2$ and $R_3$ or $R_3$ and T may respectively bond together to form rings, and in any of $R_1$, $R_2$, $R_3$ or T, mutually bonded dimers or polymers may be formed via divalent or higher than divalent groups; and (b) processing said imagewise exposed photographic material with a bleaching bath containing from 0.25 to 0.5 mol/liter of a (1,3-diaminopropanetetraacetato) iron(III) complex salt within the range of pH from 3.0 to 5.0.

2. The method for processing a silver halide color photographic material according to claim 1, wherein in general formula (A), $R_1$ is a $—COR_4$ wherein $R_4$ is an amino group;

l' is 0;

$R_3$ is an aliphatic oxycarbonyl group; and

T is a hydrogen atom or an aliphatic oxy group.

3. The method for processing a silver halide color photographic material according to claim 1, wherein compounds of general formula (A) are joined to form a polymer.

4. The method for processing a silver halide color photographic material according to claim 3, wherein compounds of general formula (A) when joined to form a polymer contain repeating units of general formula (B):

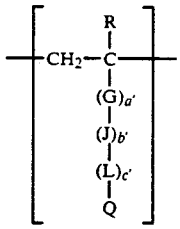

(B)

wherein

R represents a hydrogen atom, an alkyl group with 1 to 4 carbon atoms or a chlorine atom;

G represents —CONH—, —COO— or a substituted or unsubstituted phenylene group;

J represents a substituted or unsubstituted alkylene group, phenylene group or aralkylene group;

L represents —CONH—, —NHCONH—, —NHCOO—, —NHCO—, —OCONH—, —NH—, —COO—, —OCO—, —CO—, —O—, $—SO_2—$, $—NHSO_2—$ or $—SO_2NH—$; a', b' and c' each represents 0 or 1; and Q represents a cyan coupler radical in which a hydrogen atom other than the hydrogen atom in the hydroxyl group in the 1-position has been excluded from a compound represented by general formula (A).

5. The method for processing a silver halide color photographic material according to claim 4, further comprising compounds of general formula (B) formed as copolymers with non-color-forming ethylenic monomers.

6. The method for processing a silver halide color photographic material according to claim 5, wherein said non-color-forming ethylenic monomers are acrylic acid esters, methacrylic acid esters, or maleic acid esters.

7. The method for processing a silver halide color photographic material according to claim 1, wherein the pH of said bleaching bath is about 3.5 to 4.5.

8. The method for processing a silver halide color photographic material according to claim 1, wherein the time for the desilvering step is from 1 to 4 minutes.

9. The method for processing a silver halide color photographic material according to claim 1, wherein the silver halides used in said photographic material comprises about 30 mol % or less silver iodide.

10. The method for processing a silver halide color photographic material according to claim 1, wherein said bleaching bath further contains an organic acid having an acid dissociation constant (pKa) of from 2.5 to 5.5 in an amount of from 0.5 to 1.5 mols per liter of the bleaching solution.

11. The method for processing a silver halide color photographic material according to claim 10, wherein the organic acid is selected from the group consisting of acetic acid, citric acid, malonic acid, benzoic acid, formic acid, butyric acid, malic acid, tartaric acid, oxalic acid, propionic acid, and phthalic acid.

12. The method for processing a silver halide color photographic material according to claim 11, wherein the organic acid is acetic acid.

13. The method for processing a silver halide color photographic material according to claim 1, wherein said bleaching bath contains a 1,3-diaminopropanetetraacetic acid iron(III) complex salt in an amount of from 0.3 to 0.5 mol/liter.

* * * * *